US005238051A

United States Patent [19]

Kikuchi et al.

[11] Patent Number: 5,238,051

[45] Date of Patent: Aug. 24, 1993

[54] CONTINUOUS CASTING APPARATUS

[75] Inventors: Toshio Kikuchi; Takashi Ishizawa; Takashi Tochihara; Katsumi Funatsu; Kazuo Nagahama; Kenzo Sawada; Yoshiyasu Ishikawa; Ryuichi Kageyama; Toyohiko Kanki, all of Kitakyushu, Japan

[73] Assignees: Nippon Steel Corp.; Nittetsu Plant Designing Corp., both of Japan

[21] Appl. No.: 768,704

[22] PCT Filed: Feb. 22, 1991

[86] PCT No.: PCT/JP91/00228

§ 371 Date: Oct. 22, 1991

§ 102(e) Date: Oct. 22, 1991

[87] PCT Pub. No.: WO91/12909

PCT Pub. Date: Sep. 5, 1991

[30] Foreign Application Priority Data

| | | | |
|---|---|---|---|
| Feb. 23, 1990 | [JP] | Japan | 2-042985 |
| Mar. 9, 1990 | [JP] | Japan | 2-056608 |
| Feb. 20, 1991 | [JP] | Japan | 3-013626[U] |
| Feb. 20, 1991 | [JP] | Japan | 3-013627[U] |

[51] Int. Cl.[5] ..... B22D 27/02; B22D 11/10

[52] U.S. Cl. ..... 164/502; 164/466

[58] Field of Search ..... 164/466, 502

[56] References Cited

FOREIGN PATENT DOCUMENTS

| | | | |
|---|---|---|---|
| 58-55157 | 4/1983 | Japan | 164/466 |
| 61-129261 | 6/1986 | Japan | 164/466 |
| 1-66052 | 3/1989 | Japan | 164/466 |
| 2-284750 | 11/1990 | Japan . | |

*Primary Examiner*—Kuang Y. Lin

[57] ABSTRACT

An electromagnetic brake device for a continuous casting mold. The mold has a rectangular cross section having long sides and short sides. The mold also includes water boxes adjacent at least the long sides. The electromagnetic brake device includes an electromagnet including magnetic poles which are provided respectively at the long sides of the casting mold and are disposed in opposed relation to each other. The magnetic poles have a width generally equal to a width of the long sides of the casting mold. Coils are wound on outer peripheries of the magnetic poles. An iron core is provided in surrounding relation to the casting mold, a portion of the iron core opposite each of the short sides of the casting mold extends through the water boxes located adjacent the long sides of the casting mold. The water boxes include openings through a surface into which the magnetic poles are adapted to be inserted. A backup plate is provided at a side of the water boxes located adjacent the mold.

18 Claims, 32 Drawing Sheets

Prior Art

Prior Art

Prior Art

CONTINUOUS CASTING APPARATUS

BACKGROUND ART

This invention relates to a continuous casting apparatus, and more particularly to an electromagnetic brake device for a continuous casting mold which applies braking to a flow of molten steel from an immersion nozzle in the continuous casting of steel, thereby reducing inclusions contained in the molten steel.

Japanese Patent Unexamined Publication No. 63-203256 discloses a technique directed to an apparatus for decelerating a flow of molten steel from an immersion nozzle in a casting mold to reduce inclusions contained in the molten steel.

As shown in FIGS. 1 and 2, in this technique, two pairs of magnetic poles 12 of an electromagnetic brake are disposed locally laterally of a molten steel discharge flow path of an immersion nozzle 29. Electromagnets 11 used here have a laterally-elongated horse shoe-shape in a horizontal cross-section, and coils 28 are wound respectively on the opposite ends of each electromagnet, and these portions serve as the magnetic poles 12.

As shown in FIG. 3, the magnetic poles 12 are inserted respectively into openings 33 provided in long-side water boxes 2 of the mold, and are extended through long-side backup plates (not shown), and the end faces of the magnetic poles are secured to long-side copper plates 3 by bolts, thereby mounting yoke portions 13 of the electromagnets 11 on the long-side water boxes 2. The long-side water box 2 is mounted on a mold support frame 35 through support shafts 34 mounted on the opposite ends of this box. The mold support frame 35 is mounted on vibration tables 8. The long-side backup plate, covering a region 0.5 to 2 times larger in size than each side of the magnetic pole with reference to the center of the magnetic pole, is made of a magnetic material.

In FIGS. 1, 2 and 3, 4 denotes a short-side backup plate, 5 denotes a short-side copper plate, 26 denotes a cast piece, 29*a* denotes a molten steel outlet, 30 denotes the molten steel, and 40 denotes lines of magnetic force.

In the technique disclosed in the above Japanese Patent Unexamined Publication No. 63-203256, since the magnetic poles 12 are disposed locally along the molten steel discharge flow path of the immersion nozzle 29 as shown in FIG. 4A, the discharge flow, after passing past the magnetic field, hardly becomes a uniform flow, as shown in FIG. 4B, and the inclusions in the molten steel flow are involved internally to intrude deep into the molten steel, so that the effect of reducing the inclusions can not be sufficiently expected.

The electromagnetic brake device has a considerable weight, and in the type of construction fixedly mounted in the casting mold, this device vibrates together with the casting mold during the operation, and therefore it is necessary to firmly fix the device to the casting mold. As a result, particularly when grounding the device to an already-installed continuous casting apparatus, there are needed considerably extensive modifications of the equipment, such as an increased outer size due to a rigid construction of the casting mold, an increased motor capacity due to an increased load on the mold vibrating device, and an increased strength of a drive system necessitated by it. Therefore, much cost is required for the modifications, and there are encountered many drawbacks such as an installation difficulty.

Japanese Patent Publication No. 49-30613 discloses a technique in which magnetic poles of an electromagnet are disposed outside a casting mold, and windings are wound on them, and the magnetic poles are connected together by yokes to provide an integral construction. Lines of magnetic force pass through molten steel poured into the casting mold. However, in the technique disclosed in the above Japanese Patent Publication No. 49-30613, the width of the magnetic pole is small relative to the width of the casting mold, and as a result a sufficient magnetic flux density is not produced at the widthwise ends of the casting mold, and inclusions are inevitably involved internally to intruded own ward, so that the effect of reducing the inclusions can not be sufficiently expected.

For example, Japanese Patent Unexamined Publication No. 1-271031 proposes, as a method of producing a composite steel material by continuous casting equipment, a technique in which an electro-magnetic brake device is mounted within a continuous casting mold. In this technique, two immersion nozzles of different lengths are used, and an electromagnet is provided between molten steel injection portions of these immersion nozzles, and a double-layer composite cast piece in which the boundary between the surface layer portion and the inner layer portion is made clear by magnetic means is obtained.

However, a specific construction of the electromagnetic brake device for such a continuous casting mold has never been disclosed or reported so far.

Japanese Patent Unexamined Publication No. 1-99763 describes that in the technique disclosed in the above Japanese Patent Unexamined Publication No. 63-203256, the magnetic flux density necessary for decelerating the molten steel flow from the immersion nozzle to reduce the inclusions contained in the molten steel is 2500 to 3500 Gauss.

However, with respect to this technique, when a composite steel material is to be produced using two immersion nozzles, it is necessary to separate the molten steel for a surface layer, injected from the nozzle at the upper portion of the casting mold, from the molten steel for an inner layer injected from the lower nozzle. Therefore, there is needed the magnetic flux density which is uniform over the entire width of the cast piece and has a value about twice larger than the above-mentioned value. As a result, the outer shape of the electromagnet becomes larger than that of the casting mold, and an available installation space is limited by the provision of peripheral devices such as a tundish-car and a mold vibrating device, which results in a problem that the installation becomes impossible. Further, generally, in the production of a composite steel material, metal used for a surface layer has higher quality and more excellent properties, such as corrosion resistance and wear resistance, than metal for an inner layer. From the viewpoint of the production cost, it is important to obtain the optimum thickness of the surface layer metal. Further, in the casting of the double-layer cast piece, if the immersion nozzle for the inner layer metal is too long, it becomes clogged during the use, and also due to troubles such as one that it is liable to be broken, a durability problem is encountered. For these reasons, it is most preferred that the electromagnetic brake device should be mounted within the casting mold. However, in this case, for the above-mentioned reasons, there is encountered a problem that in practical use, it is impossible to install it.

SUMMARY OF THE INVENTION

In order to solve the problems of the above prior art, the present invention is constructed as follows:

Magnetic poles of an electromagnet, each having a width generally equal to a width of a long side of a casting mold, are disposed in opposed relation to each other so as to exert a magnetic field uniformly over the entire width of the casting mold to uniformly brake a flow of molten steel, after passing past the magnetic field. By doing so, inclusions, contained in the molten steel, are prevented from intruding into the lower portion, and also a surging on the surface of the molten steel is eliminated.

A long-side water box of the casting mold of a rectangular cross-section has an opening into which the magnetic pole of the electromagnet generally equal in width to the long side can be inserted. Therefore, the magnetic flux density can be exerted uniformly over the entire width of the casting mold.

Since the electromagnet is divided into four sections, that is, long-side yokes and short-side yokes, the connection of the electromagnet to the casting mold, as well as the disassembly, can be effected easily. Further, spacers are provided at the dividing portions, and the gap between the yokes (i.e., between the iron cores) is minimized, thereby preventing the lowering of the ability of the electromagnet.

The height of the magnetic pole of the electromagnet is higher at its end potions of the long side than at its central portion of the long side. With this arrangement, the magnetic field is enhanced at the end portions of the long side, thereby compensating for a reduction of the magnetic field at the end portions of the long side relative to the magnetic field at the central portion of the long side. Therefore, the uniform magnetic field can be produced over the entire width of the molten steel in the casting mold, so that the molten steel flow, after passing past the magnetic flux, can be uniformly braked, and also the intrusion of the molten steel flow into the lower portion after impingement on the short-side wall scan be avoided. When part of a long-side backup plate is made of a magnetic material, there can be achieved a uniform magnetic field, in case where the attenuation of the magnetic flux at the opposite end portions of the magnetic pole is within 10%. As a result, the molten steel flow, after passing past the magnetic field, can be uniformly braked, and also the intrusion of the molten steel flow into the lower portion after impingement on the short-side walls can be avoided.

The electromagnets generally equal in width to the long side of the casting mold are disposed in opposed relation to each other, and are disposed between molten steel injection ports of two immersion nozzles so as to apply a magnetic field uniformly over the entire width of the casting mold. In this condition, when a double-layer cast piece is produced, the boundary between a surface layer metal and an inner layer metal is made clear, and the surface layer metal can be formed into an optimum thickness.

When the two immersion nozzles are provided, the upper portions of the long-side copper plates constituting the casting mold are cooled by upper grooves, and are supported by water boxes, and the lower portions thereof are cooled by deep holes and are supported by the electromagnet, and the distance between the opposed magnetic poles is minimized.

In order to hold the short sides of the casting mold between the opposed long sides thereof, a clamp device including tie rods and disk springs is provided at the upper water box support portion, and with respect to the lower electromagnet magnetic pole support portion, when effecting the assembling using the above clamp device, a gap is provided between the long-side yoke and the short-side yoke so as to obtain the short-side holding force.

BRIEF DESCRIPTION OF THE DRAWINGS

FIGS. 1 to 4B are views showing the prior art; FIG. 1 is a plan view of a casting mold with an electromagnetic brake device, showing a cross-section taken along the line I—I of FIG. 2; FIG. 2 is a cross-sectional view taken along the line II—II of FIG. 1; FIG. 3 is a cross-sectional view taken along the line III—III of FIG. 2; FIG. 4B is an illustration explanatory of the distribution of a discharge flow rate of molten steel in FIG. 4A; FIG. 17 is a plan view; FIG. 18 is a partly cross-sectional view taken along the line XVIII—XVIII of FIG. 17; FIG. 19 is a cross-sectional view taken along the line XIX—XIX of FIG. 17.

DESCRIPTION OF THE INVENTION

A first embodiment of a continuous casting mold of the present invention will now be described with reference to FIGS. 5 to 15B.

Figure 1:
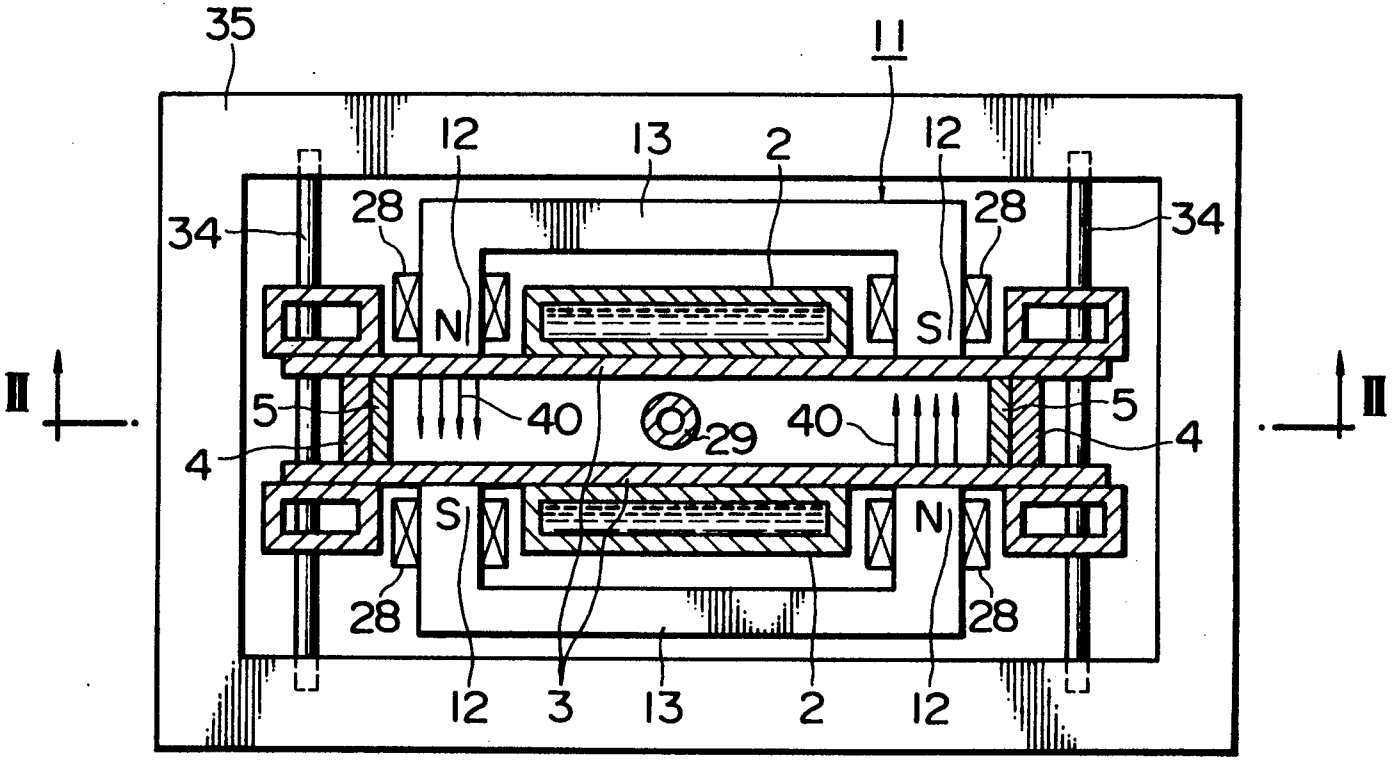
Figure 2:
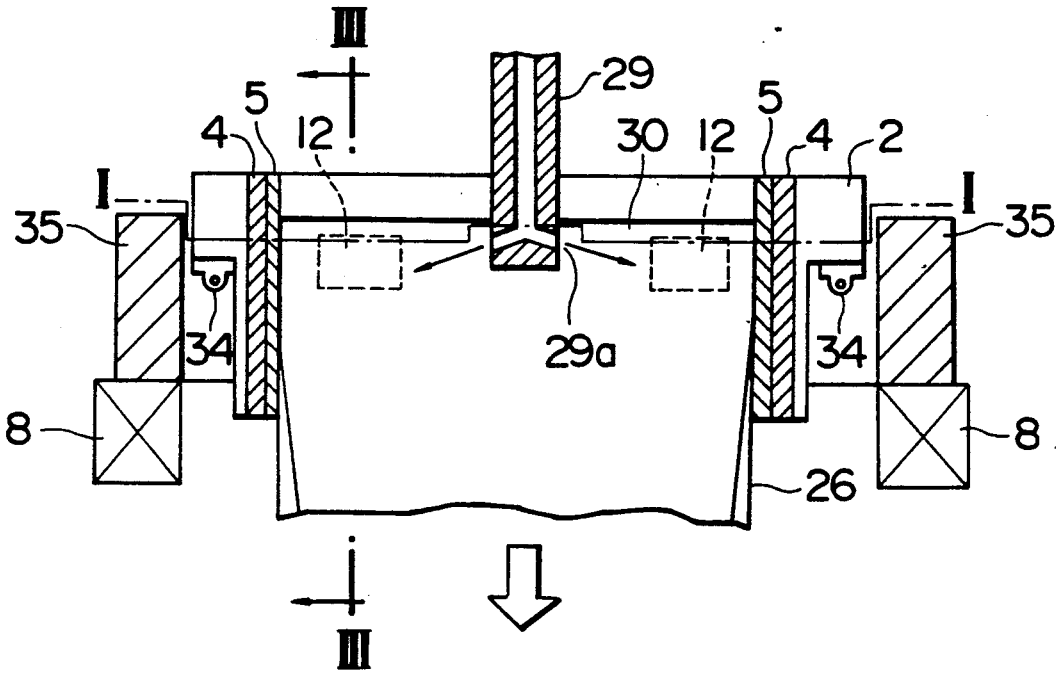
Figure 3:
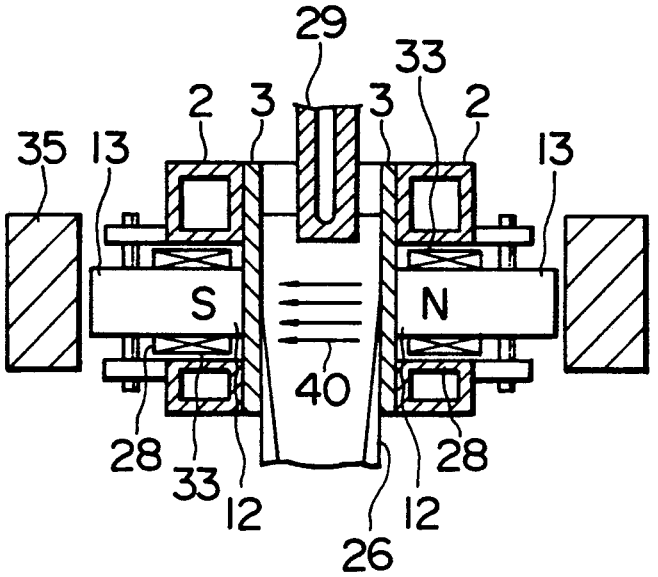
Prior Art FIG. 3
Figure 4A:
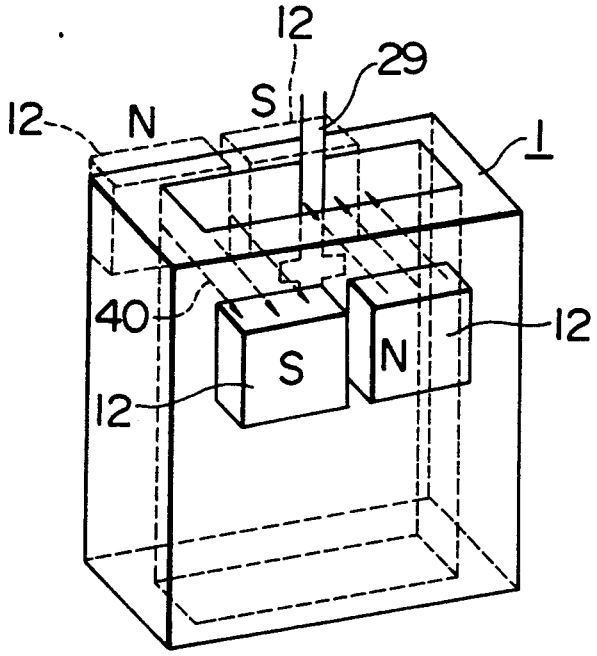
FIG. 4A is a perspective view showing the concept of a conventional electromagnetic brake device.
Figure 4B:
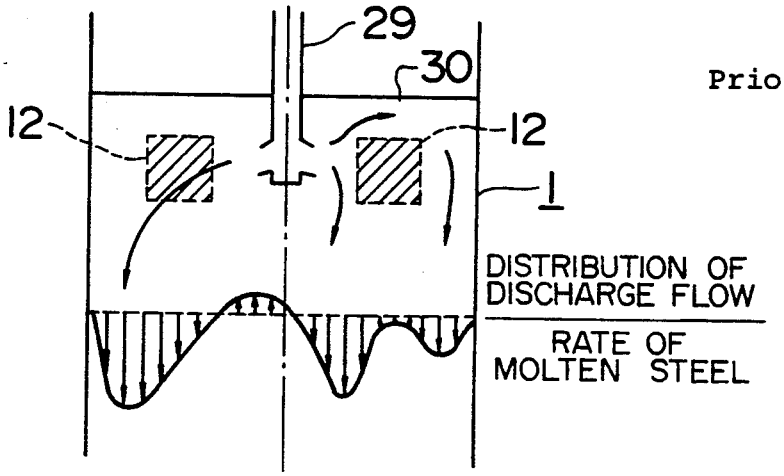
Prior Art FIG. 4B
Figure 5:
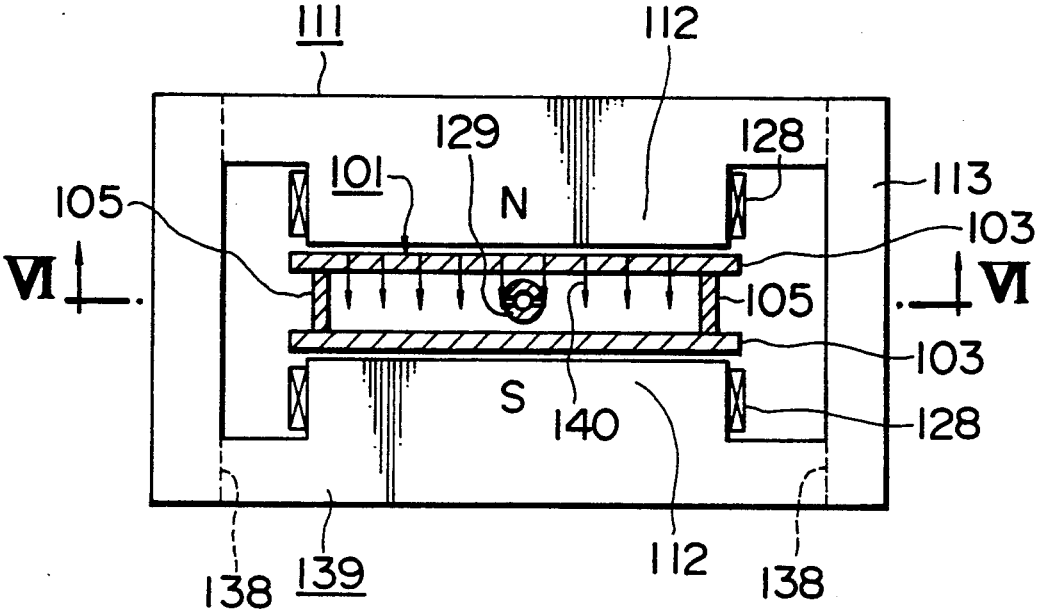
FIG. 5 is a schematic view showing the relation between a casting mold and an electromagnet in a first embodiment of the present invention.
Figure 6:
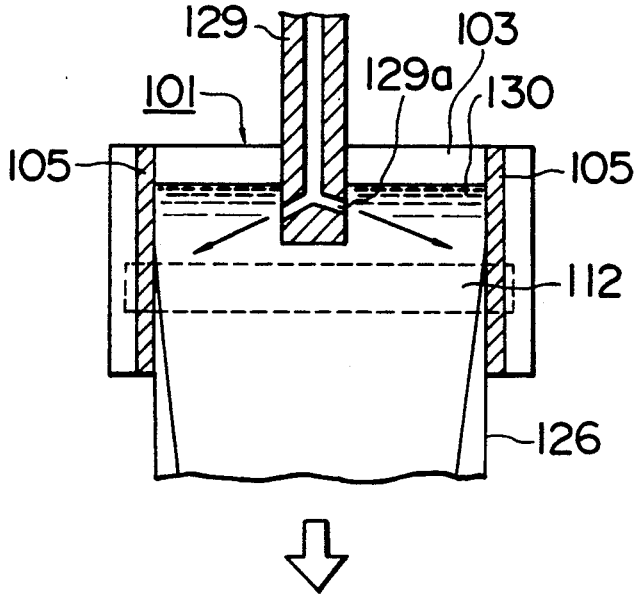
FIG. 6 is a vertical cross-sectional view taken along the VI—VI of FIG. 5.

In FIGS. 5 and 6, magnetic poles 112 of an electromagnet 111, which have a width generally equal to a width of a long-side copper plate 103 of a casting mold 101 constituted by the long-side copper plates 103 and short-side copperplates 105, are disposed in opposed relation to each other, and are disposed at the outer sides of the long-side copper plates 103, respectively, so that magnetic force lines 140 for electromagnetic braking are exerted between the magnetic poles 112.

The electromagnet 111 has the magnetic poles 112 and coils 128 wound respectively on the outer peripheries of these magnetic poles, and the casting mole 101 is surrounded by an iron core 139 including the magnetic poles 112.

When DC current flows through the coils 128, the electromagnetic 111produces the magnetic force lines 140 flowing from the north pole to the south pole. FIG. 6 shows the case where the magnetic poles 112 are provided at a level below a molten steel injection port 129*a* of an immersion nozzle 129. In this case, a discharge flow of molten steel injected from the immersion nozzle 129 is braked at the position of the magnetic poles 112, and is formed into a uniform flow.

Next, details of the present device will be described with reference to FIGS. 7 to 16D. In FIG. 9, the casting mold 101 comprises a rear long-side water box 102*a*, a backup plate 136 of stainless steel fixed thereto, a similar front long-side water box 101*b*, a similar backup plate 136 of stainless steel, the long-side copper plates 103*a*, 103*b*, short-side backup plates 104*a*, 104*b*, the short-side copper plates 105*a*, 105*b* fixed thereto, respectively, a width adjustment device 106 for adjusting the positions of the short-side copper plates 105*a*, 105*b* so as to determine a width of a cast piece, a clamp device 107 (see FIG. 10) for firmly clamping the short-side copper plates 105*a*, 105*b* between the long-side copperplates 103*a*, 103*b* during the casting.

Figure 7:
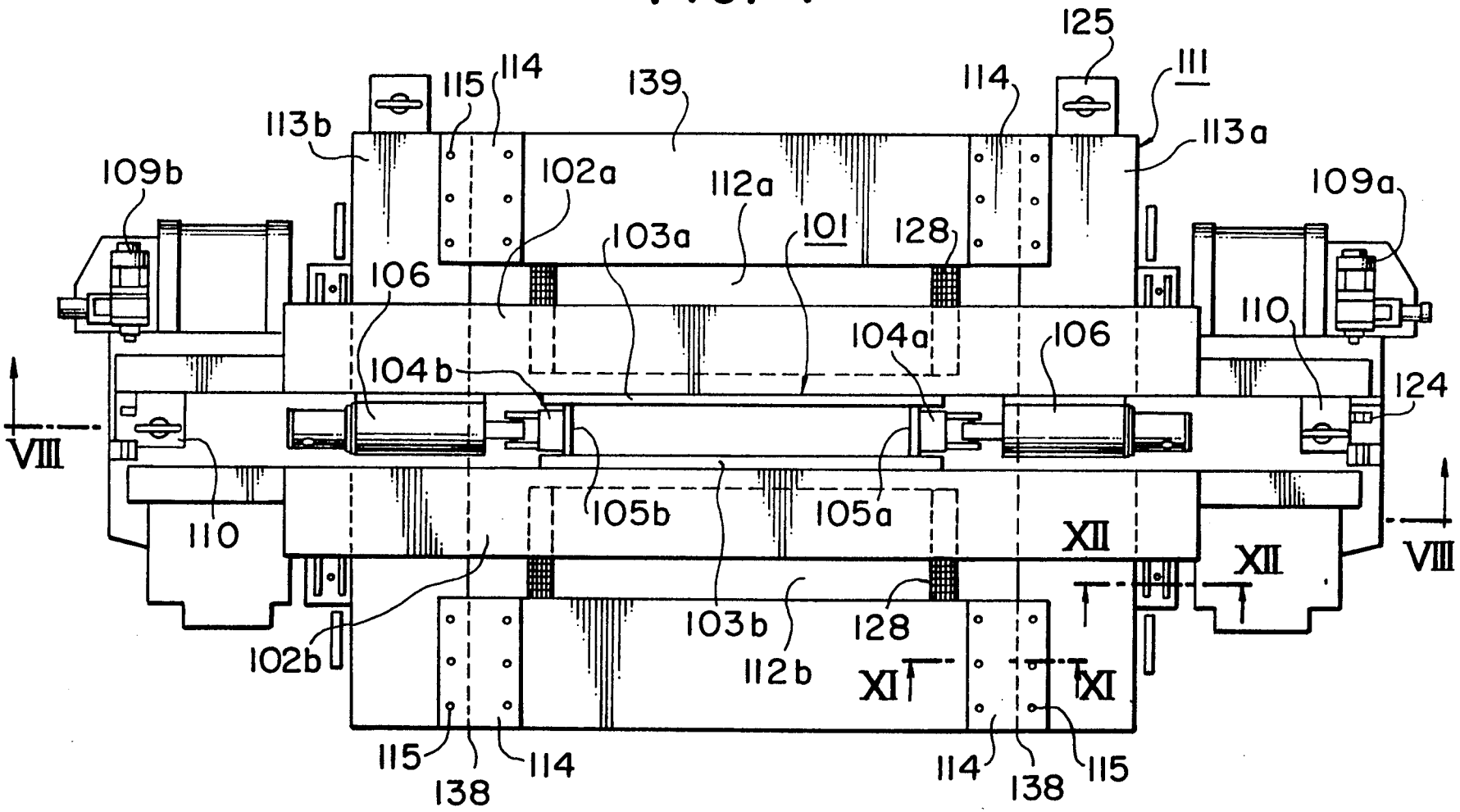
FIG. 7 is a plan view of an electromagnetic brake device according to the first embodiment of the present invention.
Figure 8:
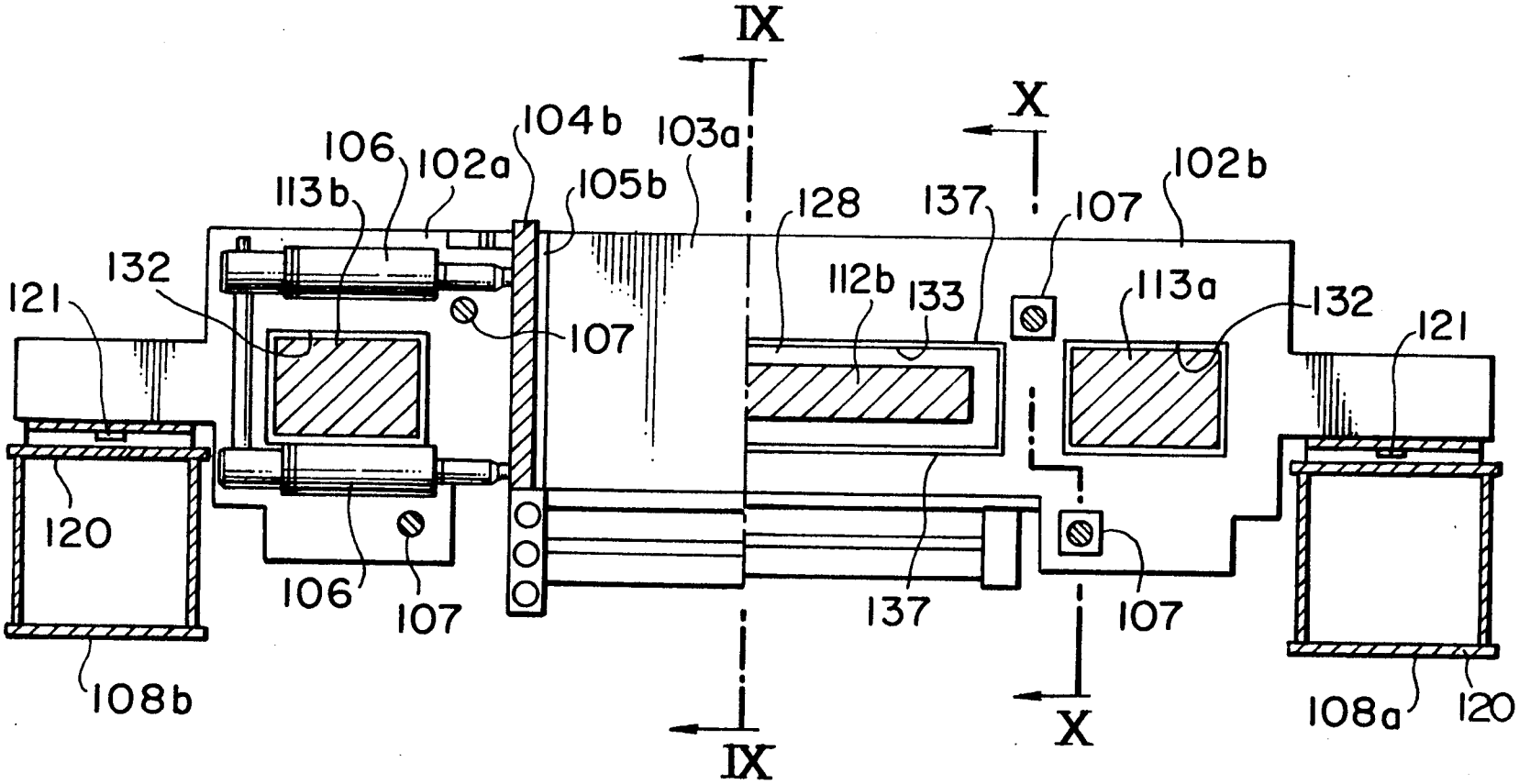
FIG. 8 is a cross-sectional view taken along the line VIII—VIII of FIG. 7.
Figure 9:
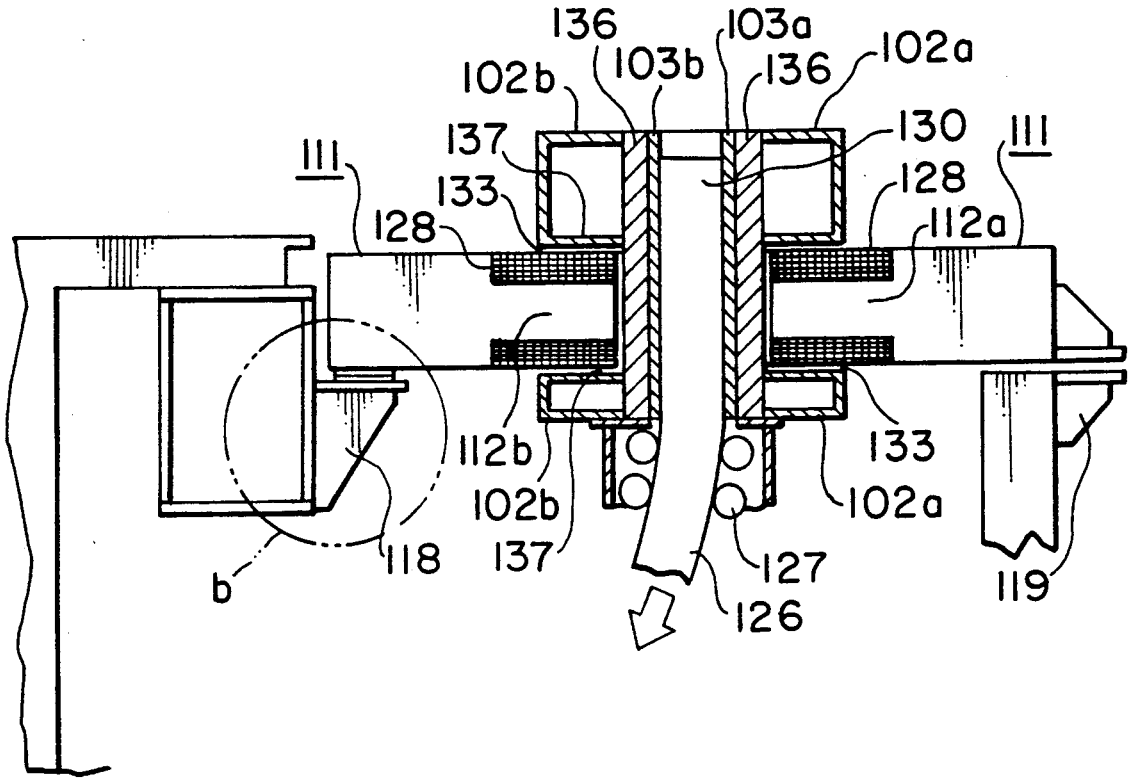
FIG. 9 is a cross-sectional view taken along the line IX—IX of FIG. 8.
Figure 10:
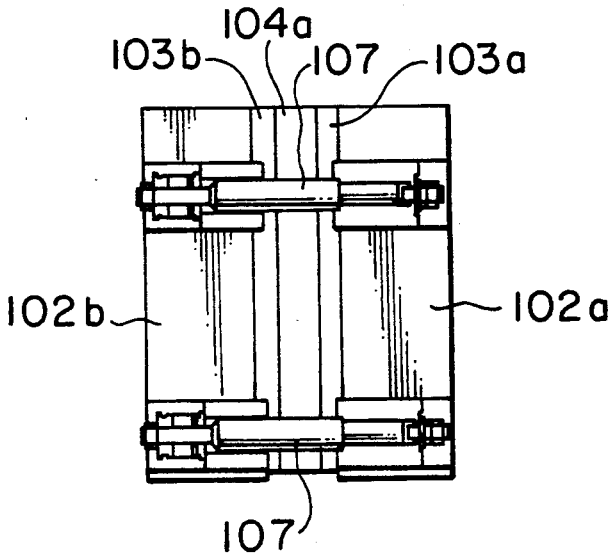
FIG. 10 is a cross-sectional view taken along the line X—X of FIG. 8.

Referring to FIGS. 7 and 8, mold fixing push devices 109*a*, 109*b* for fixing the casting mold 101 when mounting this mold, as well as a mold fixing device 110, are mounted on mold vibration tables 108*a*, 108*b*.

Figure 11:
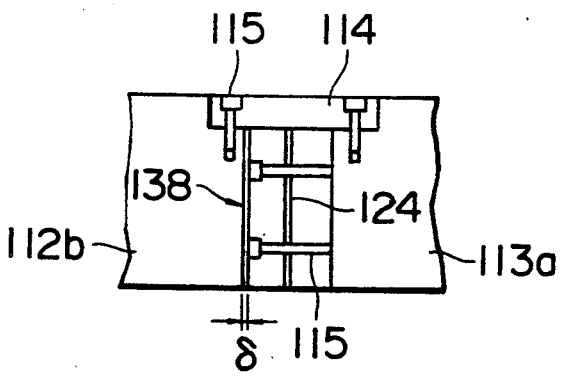
FIG. 11 is a cross-sectional view taken along the line XI—XI of FIG. 17.

As shown in FIG. 7, the electromagnet 111 is of a projected construction so that the magnetic poles 112*a*, 112*b* can be inserted respectively into rear openings of the long-side water boxes 102*a* and 102*b*. Yokes 113*a*, 113*b* for forming magnetic paths between the magnetic poles 112*a*, 112*b* are extended through the long-side water boxes 102*a*, 102*b*, and are integrally connected respectively to the magnetic poles 112*a*, 112*b* by spacers 114 and bolts 115, as shown in FIG. 11.

When the magnetic poles 112*a*, 112*b* are to be integrally connected to the yokes 113*a*, 113*b* by the spacers 114, it is necessary to make an air gap at the connection portion as small as possible in order to minimize the resistance to the passage of the magnetic flux. For this reason, the thickness of the spacer 114 can be adjusted by an adjustment shim 124, as shown in FIG. 11.

Figure 12:
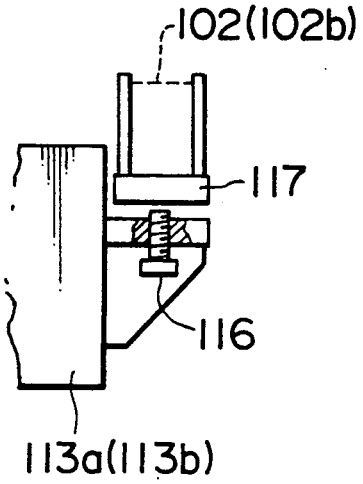
FIG. 12 is a cross-sectional view taken along the line XII—XII of FIG. 7.
Figure 13:
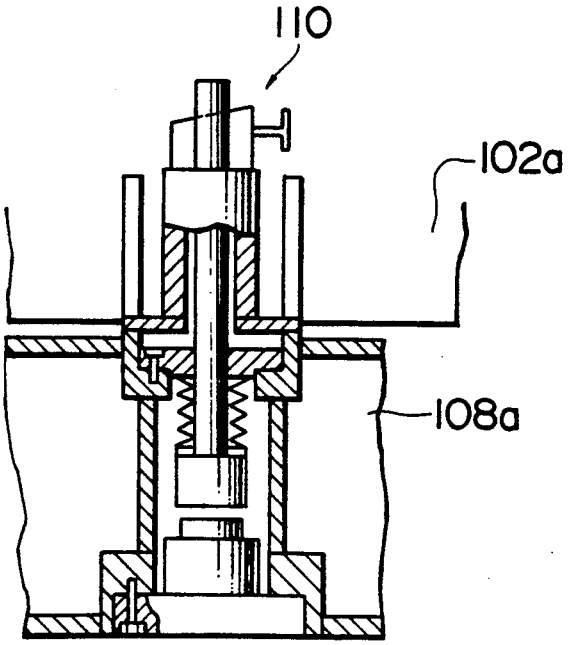
FIG. 13 is a detailed cross-sectional view of a fixing device for the casting mold and the electromagnet.
Figure 14A:
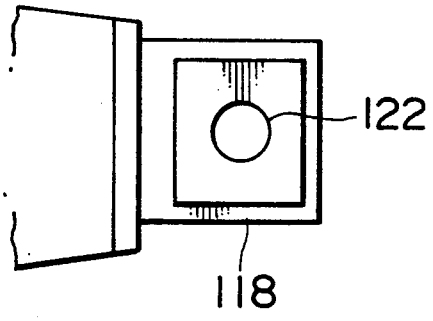
FIGS. 14A and 14B are a plan view and a side-elevational view of a portion b of FIG. 9, respectively, showing the details of an electromagnet support device.
Figure 15A:
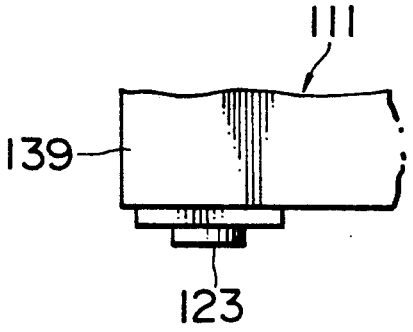
FIGS. 15A and 15B are a side-elevational view and a plan view of the portion b of FIG. 9, respectively, showing amounting portion on the part of the electromagnet.
Figure 14B:
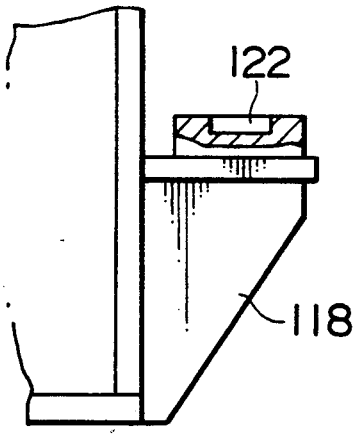
Figure 15B:
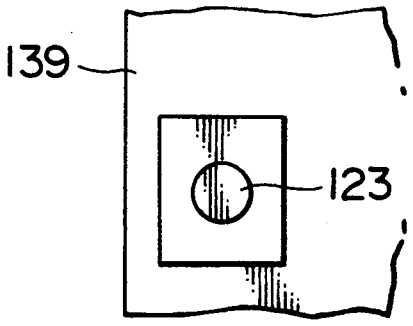

The casting mold 101 and the electromagnet 111 are before hand combined together at a place outside the continuous casting apparatus, such as a maintenance shop. In order to support the weight of the casting mold 101 by the electromagnet 111 when transporting this integrally-combined assembly to the continuous casting apparatus, jack bolts 116 serving as mold support members are provided on the yokes 113*a*, 113*b*, as shown in FIG. 12. On the other hand, receptive seats 117 for the jack bolts 116 are provided on the long-side water boxes 102*a*, 102*b*. When the assembly is to be mounted on the vibration tables 108*a*, 108*b*, the casting mold 101 is first placed on the vibration tables 108*a*, 108*b*, and then the contact between the jack bolts 116 and the receptive seats 117 is released, and the electromagnet 111 is placed on electromagnet support devices 118, 119 at a position about 10 mm lower so that it may not interfere with the casting mold even at the time of vibration of the casting mold during the casting operation.

In this case, the positioning of the casting mold 101 in the direction of the width of the cast piece is effected by key grooves 120 formed in the vibration tables 108*a*, 108*b* and keys 121 (see FIG. 8) provided at the water boxes 102*a*, 102*b*. The positioning of the electromagnet 111 is effected by recesses 112formed in the support devices 118, 119 and convex portions 123 formed on the iron core 139 of the electromagnet, as shown in FIGS. 14A to 15B.

After the casting mold 101 and the electromagnet 111 are positioned and mounted as described above, the casting mold 101 is pressed against a reference surface block 124 (see FIG. 7) by the push devices 109*a*, 109*b*, and is firmly fixed onto the vibration tables 108*a*, 108*b* by the fixing device 110. Similarly, the electromagnet 111 is fixed by a fixing device 125 (see FIG. 7) provided on the support device 119.

Figure 16A:
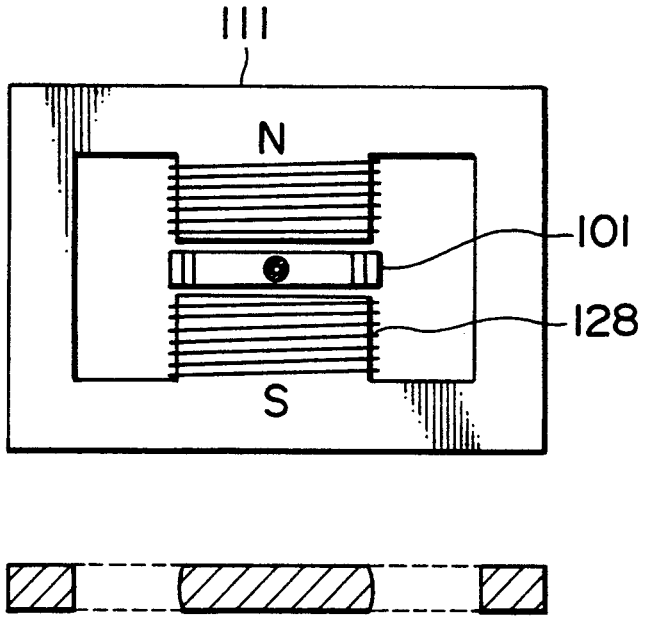
FIGS. 16A and 16B are respectively a view of a general construction of the electromagnet of the first embodiment of the invention, and an illustration showing its magnetic flux density distribution.
Figure 16B:
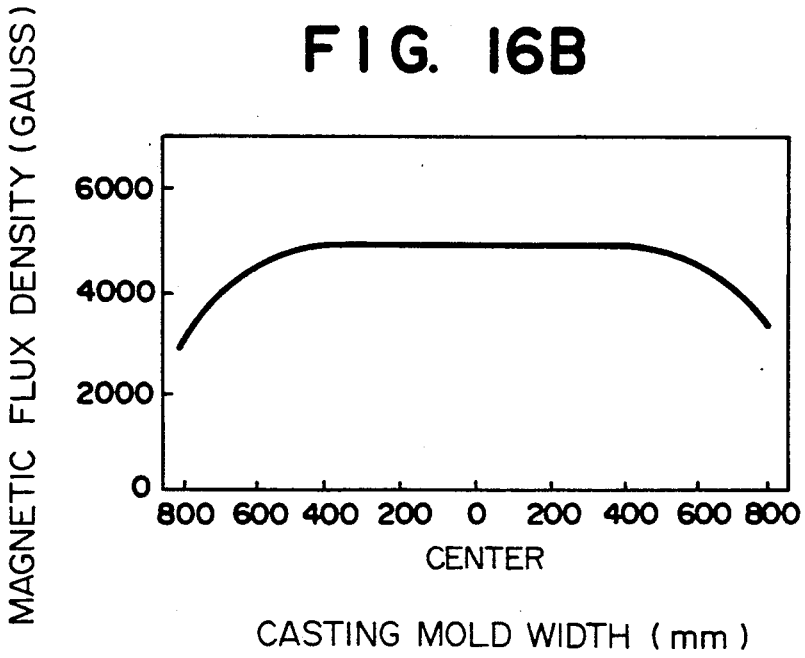
Figure 16C:
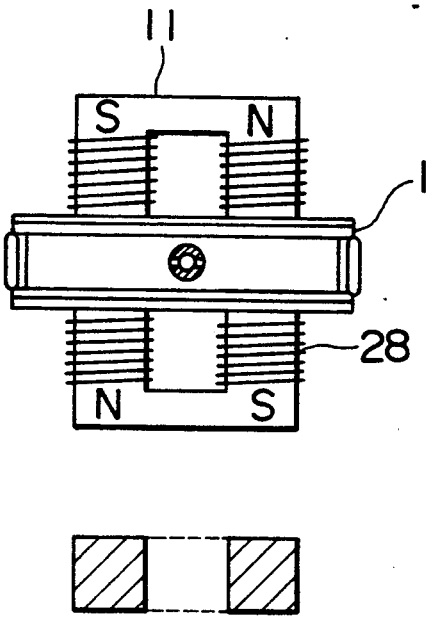
FIGS. 16C and 16D are respectively a view of a general construction of the electromagnet of the prior art, and an illustration showing its magnetic flux density distribution.
Figure 16D:
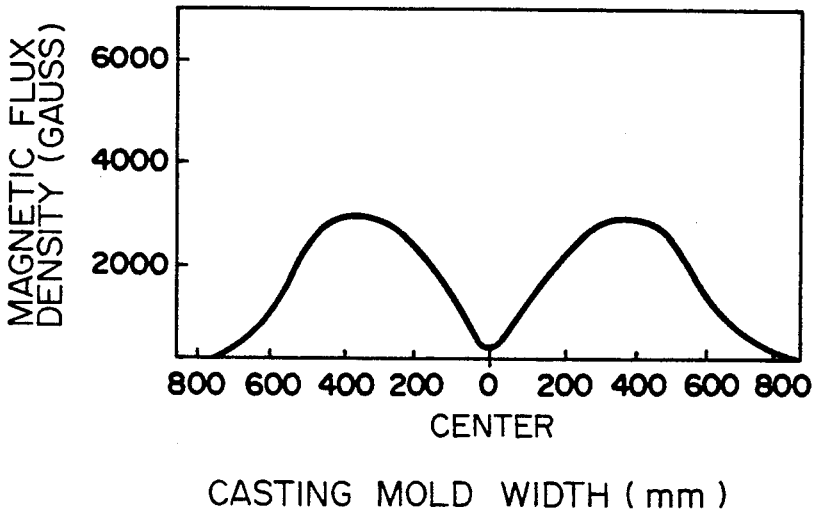

FIG. 16A schematically shows the casting mold 101 and the electromagnet 111 according to the first embodiment of the present invention, and the magnetic flux density distribution in the direction of the width of the casting mold, which is obtained with this construction, is shown in FIG. 16B. FIG. 16C schematically shows the casting mold 1 and the electromagnet 11 of the prior art, and the magnetic flux density distribution obtained with this construction is shown in FIG. 16D. As can be appreciated from these Figures, in the present invention, the magnetic flux density is high, and also the magnetic flux distribution is uniform in the direction of the width of the casting mold, thus achieving an effective operation. The above first embodiment of the present invention achieves the following effects:

(1) The openings are provided in the rear surfaces of the water boxes of the mold, and the electromagnet wider than the cast piece can be inserted thereinto, and the yokes are extended through the water boxes. With this construction, the magnetic field uniform over the entire width of the cast piece can be applied, and the deflected flow of the molten steel in the casting mold can be made uniform at the lower portion of the casting mold, thereby improving the effect of reducing the inclusions. Particularly, the downward intrusion of the inclusions, which is caused by the downward flow produced after the discharge flow from the immersion nozzle impinges on the short-side walls, is prevented, thereby improving the quality of the cast piece.

(2) The electromagnet is divided into the two magnetic pole portions and the two yoke portions, and these can be combined together by the spacers and the bolts. Therefore, the combination of the electromagnet with the casting mold, as well as the disassembly, can be done easily, and also the assembly of the casting mold and the centering thereof can be done easily. Therefore, the maintenance time and the cost can be saved, and there is required a less space for provisionally storing the electromagnet, and the handling can be facilitated.

(3) Since the casting mold and the electromagnet can be formed into the combined construction, there is no connecting portion, and the casting mold is merely contacted with and supported by the jack bolts provided on the electromagnet, and the electromagnet is independently supported within the continuous casting apparatus. With this construction, the increase of the load on the mold vibrating device can be avoided, and there is no need at all to increase the motor capacity and to increase the strength of the drive system, and the cost for the equipment modifications can be saved, and the time required for the installation can be shortened.

Figure 17:
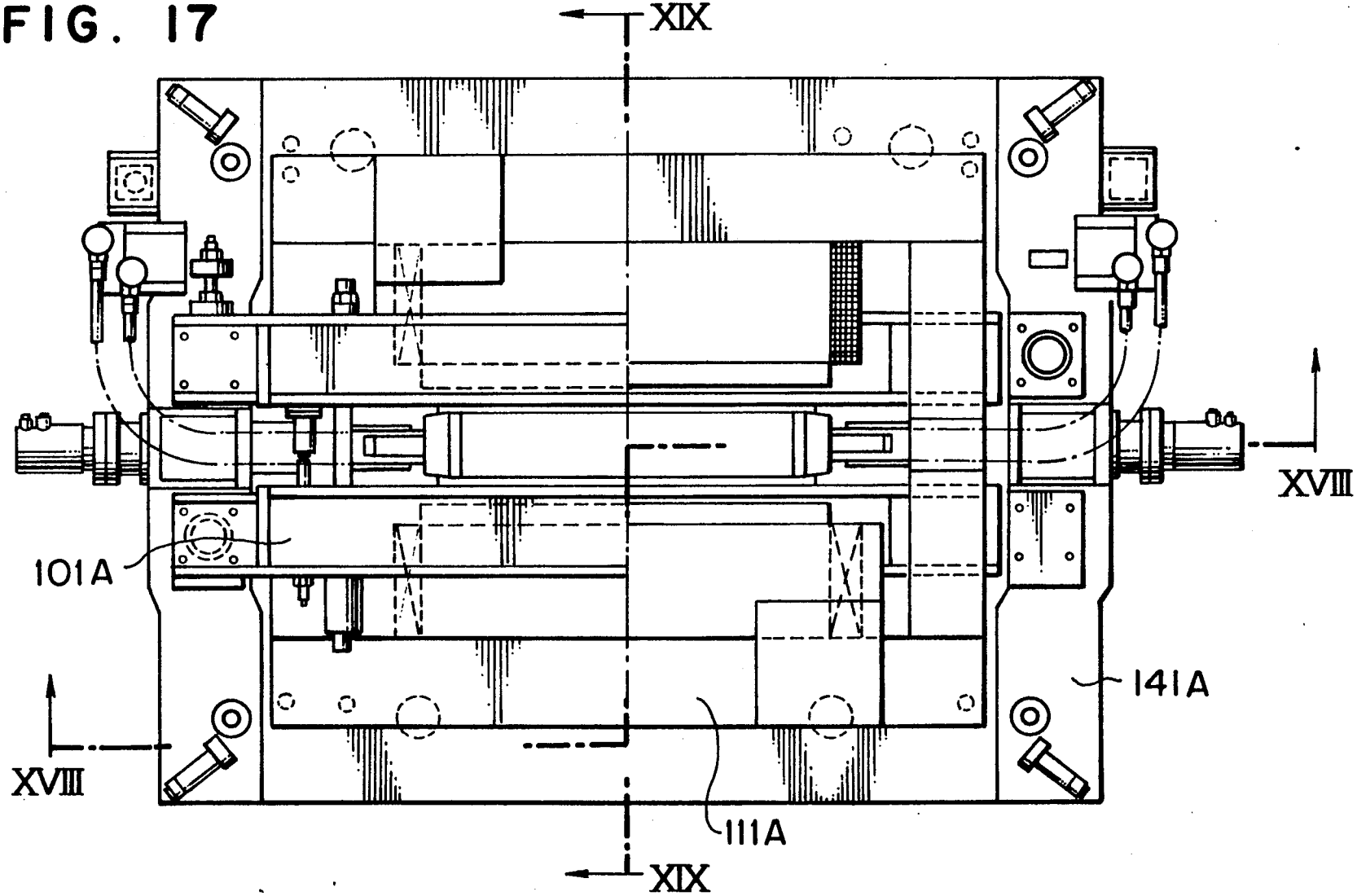
FIGS. 17 to 19 views showing a casting mold and an electromagnetic brake device according to a second embodiment of the present invention.
Figure 18:
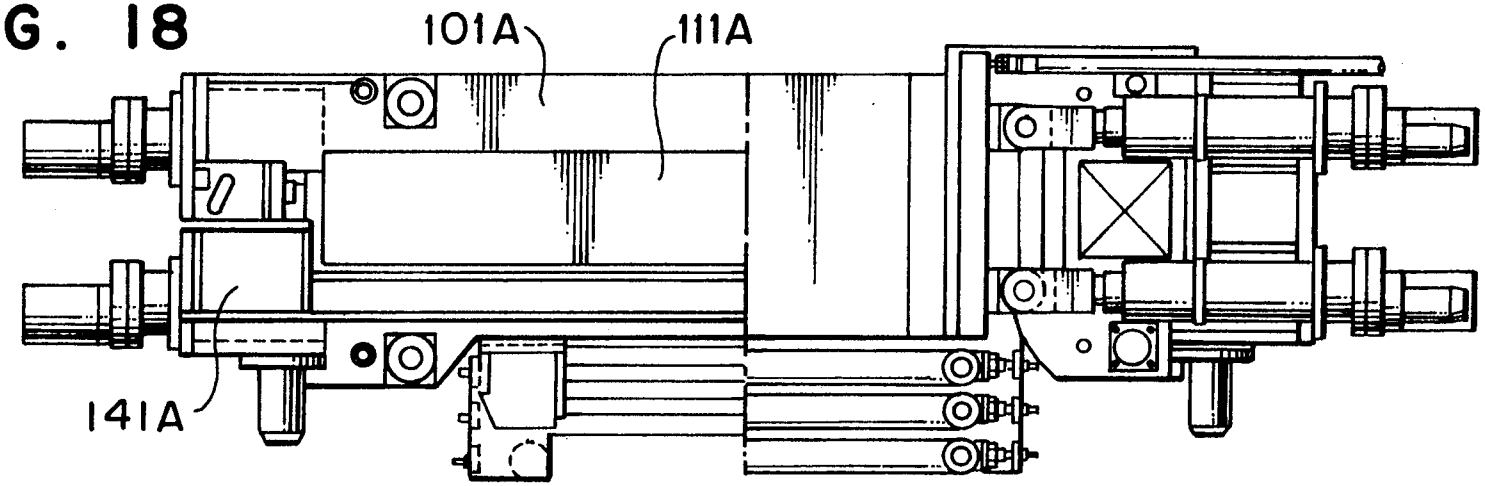
Figure 19:
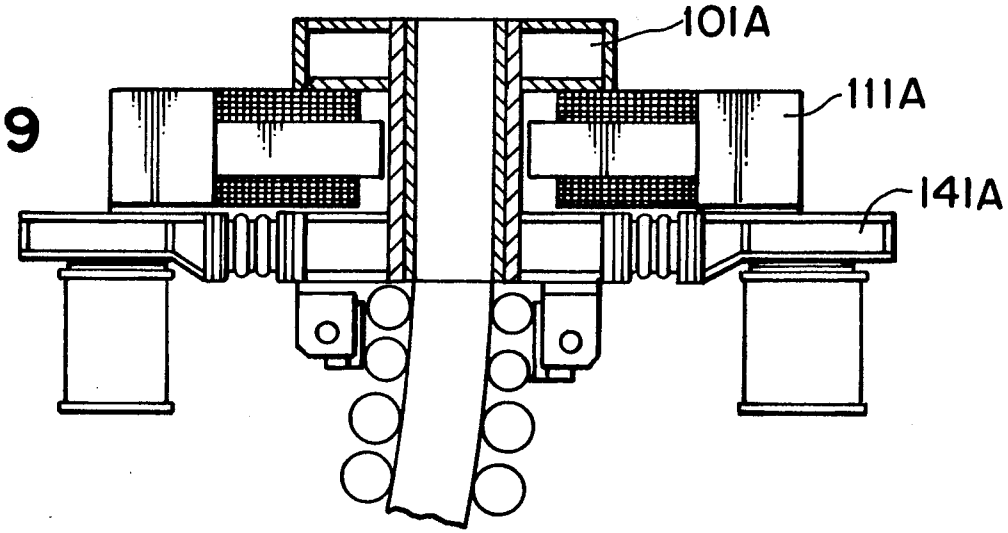

FIGS. 17 to 19 show a second embodiment of the present invention. This second embodiment differs from the first embodiment in that a casting mold 101A and an electromagnet 111A are fixedly mounted on a common mold support frame 141A.

Figure 20:
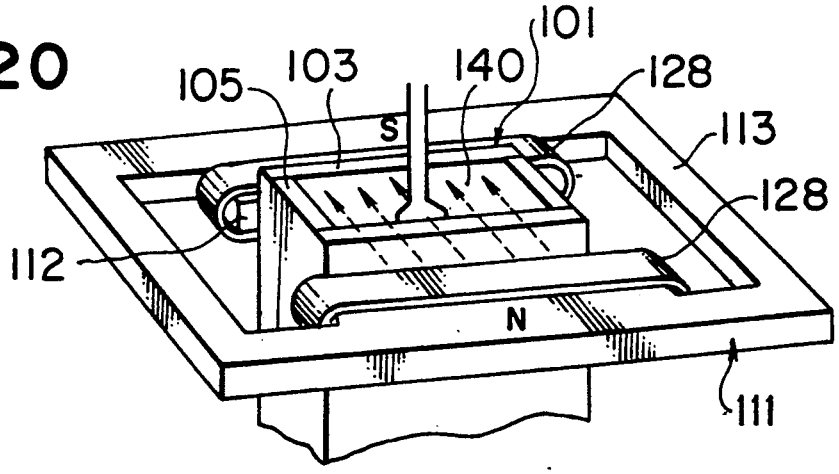
FIG. 20 is a perspective view schematically showing the casting mold and the electromagnet according to the first embodiment of the present invention.
Figure 21:
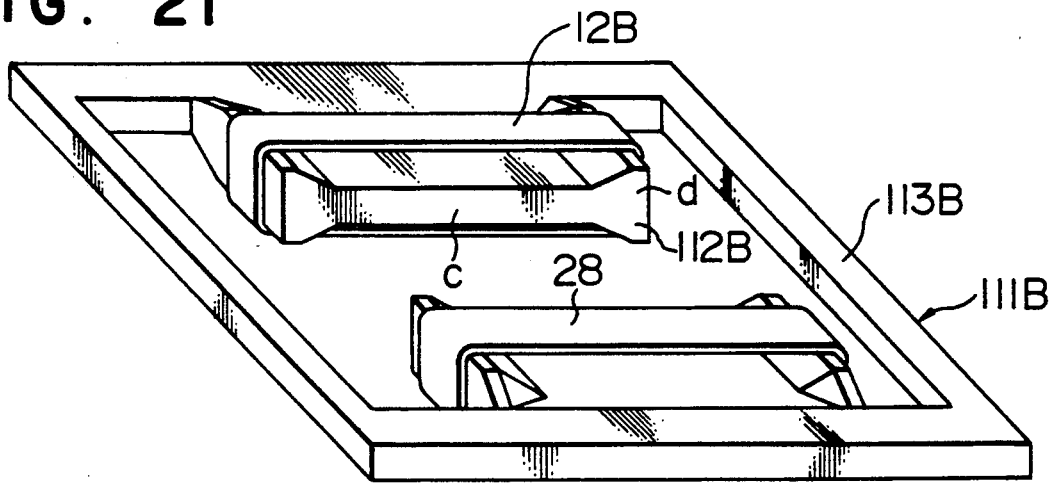
FIG. 21 is a perspective view showing an iron core of an electromagnet according to a third embodiment of the present invention.

FIG. 21 shows an electromagnet 111B according to a third embodiment of the present invention, and FIG. 20 schematically shows the casting mold 101 and the electromagnet 111 according to the first embodiment of the present invention shown in FIG. 5.

In FIG. 20, the magnetic poles 112 of the electromagnet 111, which are greater in width than the long-side copper plate 103 of the casting mold 101 constituted by the long-side copper plates 103 and short-side copper plates 105, are disposed in opposed relation to each other, and are disposed at the outer sides of the long-side copper plates 103, respectively, so that magnetic force lines 140 for electromagnetic braking are exerted between the magnetic poles 112. The electromagnet 111 has the magnetic poles 112 and the coils 128 wound respectively on these magnetic poles. When DC current flows through the coils 128, the electromagnet 111 produces the magnetic force lines 140 flowing from the north pole to the south pole.

The distribution of the magnetic field produced in the molten steel depends on the gap between the opposed magnetic poles and the shape of the magnetic poles. In the first embodiment of the present invention, the rectangular electromagnet having a width generally equal to the width of the long side of the casting mold of a rectangular cross-section is provided at this long side, and the magnetic field at each end of the long side of the casting mold is weaker that the magnetic field at the central portion of the long side, and the uniform magnetic field can not be produced over the entire width of the molten steel in the casting mold. Namely, the magnetic field can not be exerted uniformly over the entire width of the casting mold, and the uniformity of the molten steel flow after passing past the magnetic field is impaired, and the inclusions can not be removed sufficiently.

In FIG. 21, the third embodiment differs from the first embodiment in that a magnetic pole 112B has a lower-height portion c at a central portion of the long side thereof and a higher-height portion d at each end of the long side.

Figure 22:
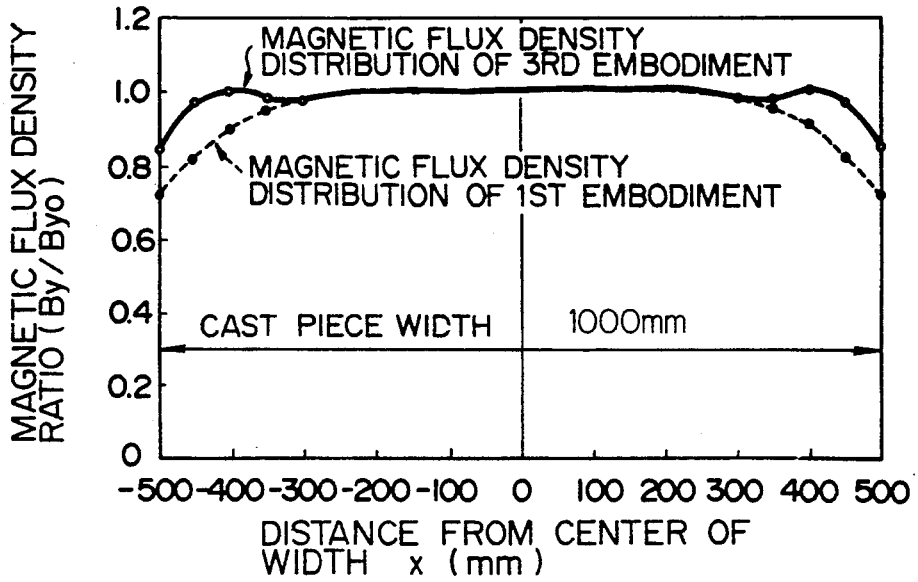
FIG. 22 is a graph showing the magnetic flux density distributions of the first and third embodiments of the present invention.

FIG. 22 is an illustration showing a comparison between the magnetic flux density distributions produced respectively by the electromagnets of the first and third embodiments of the present invention in the molten steel. As can be appreciated from this illustration, in the case of the third embodiment, the magnetic flux density distribution is generally uniform in the direction of the width of the casting mold 111B, thus achieving an effective operation.

The third embodiment of the present invention achieves the following effect. The electromagnetic brake is constructed by the electromagnet having the magnetic poles whose width is greater than the width of the casting mold, and the height of the end of the long side of the magnetic pole is higher than the height of the central portion of the long side. Therefore, the uniform magnetic field can be applied over the entire width of the cast piece, and the uniformity of the deflected flow of the molten steel in the casting mold is achieved at the lower portion of the casting mold, thereby improving the effect of reducing the inclusions.

FIGS. 23 to 28 show a continuous casting mold according to a fourth embodiment of the present invention. In these Figures, those parts common to the first embodiment shown in FIGS. 5 to 15B are designated by identical reference numerals, respectively. The fourth embodiment of the present invention differs from the first embodiment in that part of each backup plate 136C is made of a magnetic material.

Figure 23:
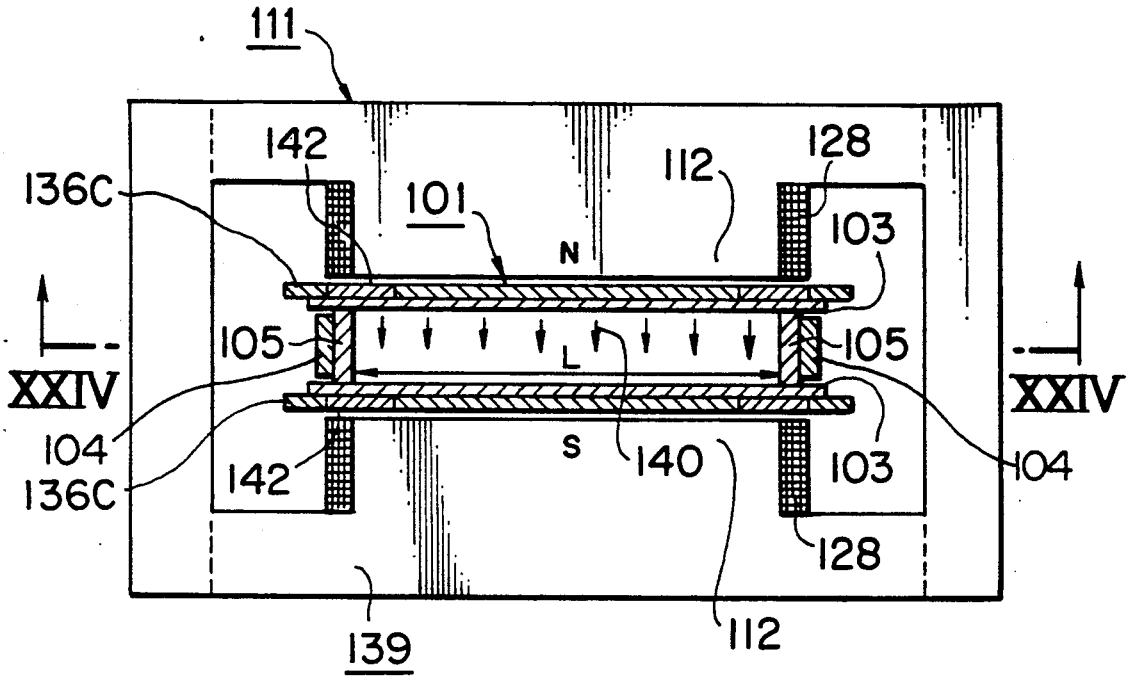
FIG. 23 is a plan view schematically showing a casting mold and an electromagnet according to a fourth embodiment of the present invention.
Figure 24:
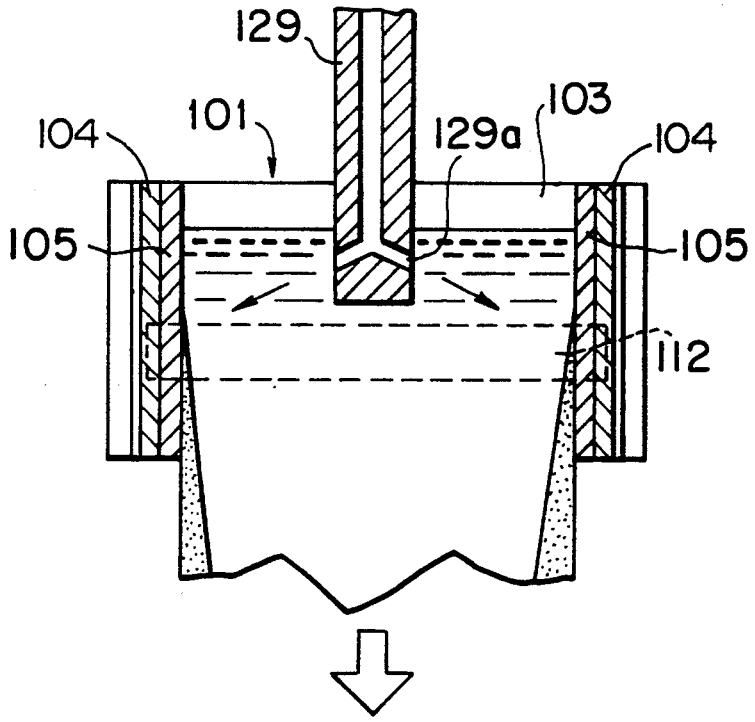
FIG. 24 is a cross-sectional view taken along the line XXIV—XXIV of FIG. 23.

In FIGS. 23 and 24, magnetic poles 112 of an electromagnet 111, which have a width generally equal to a width of a long-side copper plate 103 of a casting mold 101 constituted by the long-side copper plates 103 and short-side copper plates 105 are disposed in opposed relation to each other, and are disposed at the outer sides of the long-side copper plates 103, respectively, so that magnetic force lines 140 for electromagnetic braking are exerted between the magnetic poles 112.

The electromagnet 111 has the magnetic poles 112 and coils 128 wound respectively on these magnetic poles, and the casting mold 101 is surrounded by an iron core 139 including the magnetic poles 112.

When DC current flows through the coils 128, the electromagnet 111produces the magnetic force lines 140 flowing from the north pole to the south pole.

The long-side copper plates 103 are firmly supported respectively by the backup plates 136C of a non-magnetic material (austenite-type stainless steel), and those portions of the backup plate 136C facing the ends of the magnetic pole 112 are made of a hard material such as soft steel or an iron-cobalt alloy. FIG. 24 is a view in which the magnetic poles 112 are disposed at a level below a molten steel injection port 129*a* of an immersion nozzle 129, and in this case the discharge flow of molten steel injected from the immersion nozzle 129 is braked at the position of the magnetic poles 112 to be formed into a uniform flow.

Figure 25:
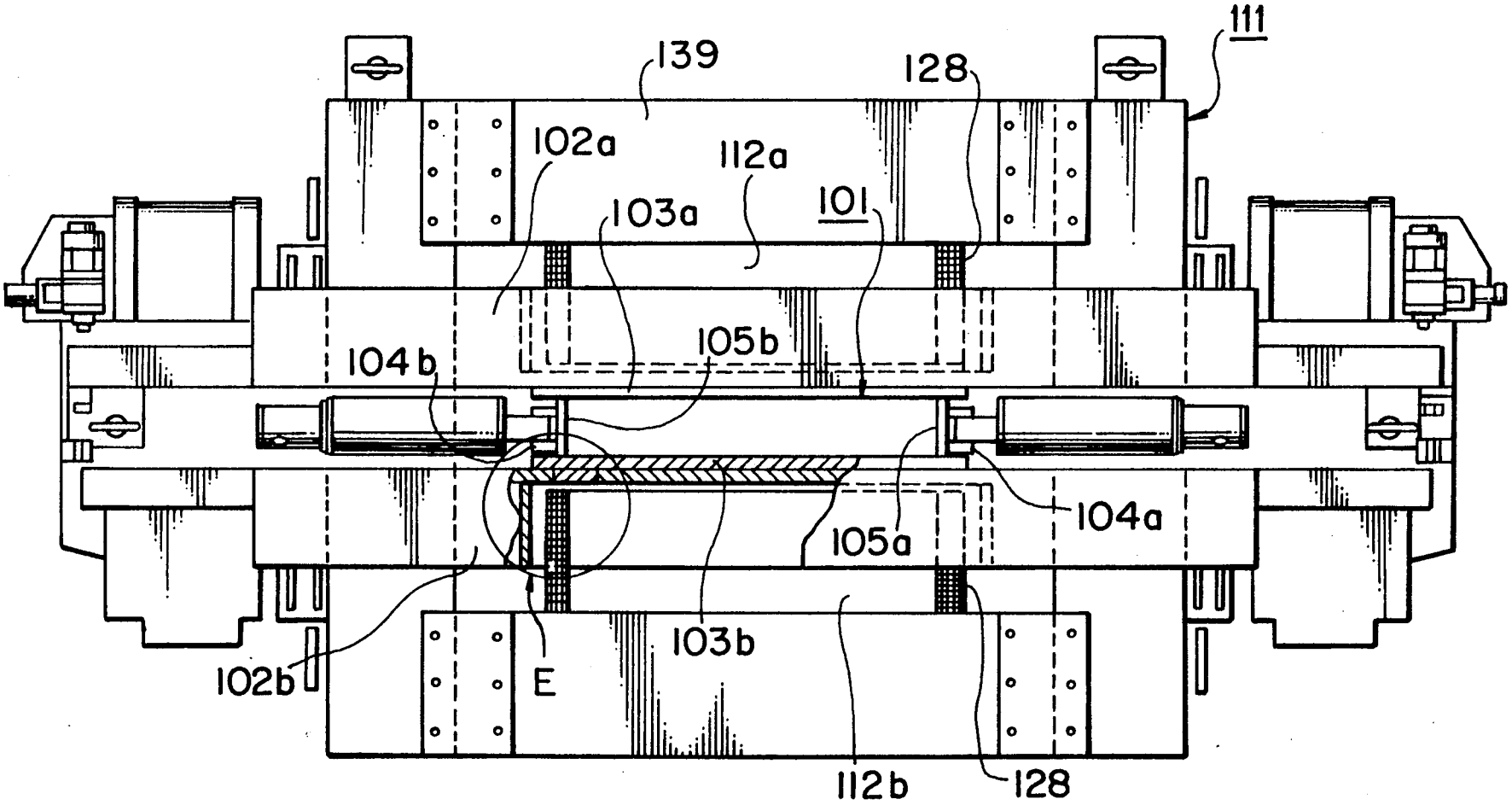
FIG. 25 is a plan view similar to FIG. 7, but showing the fourth embodiment.
Figure 26:
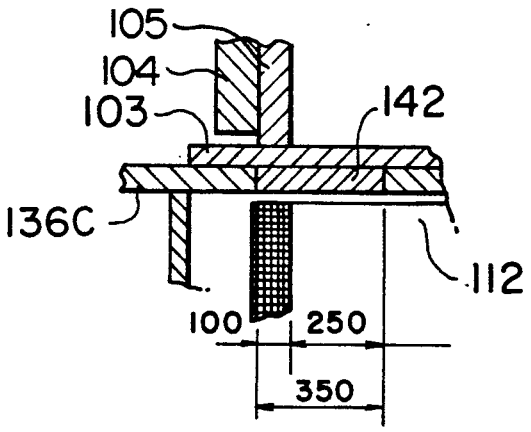
FIG. 26 is a view showing the details of a portion E of FIG. 25.
Figure 27:
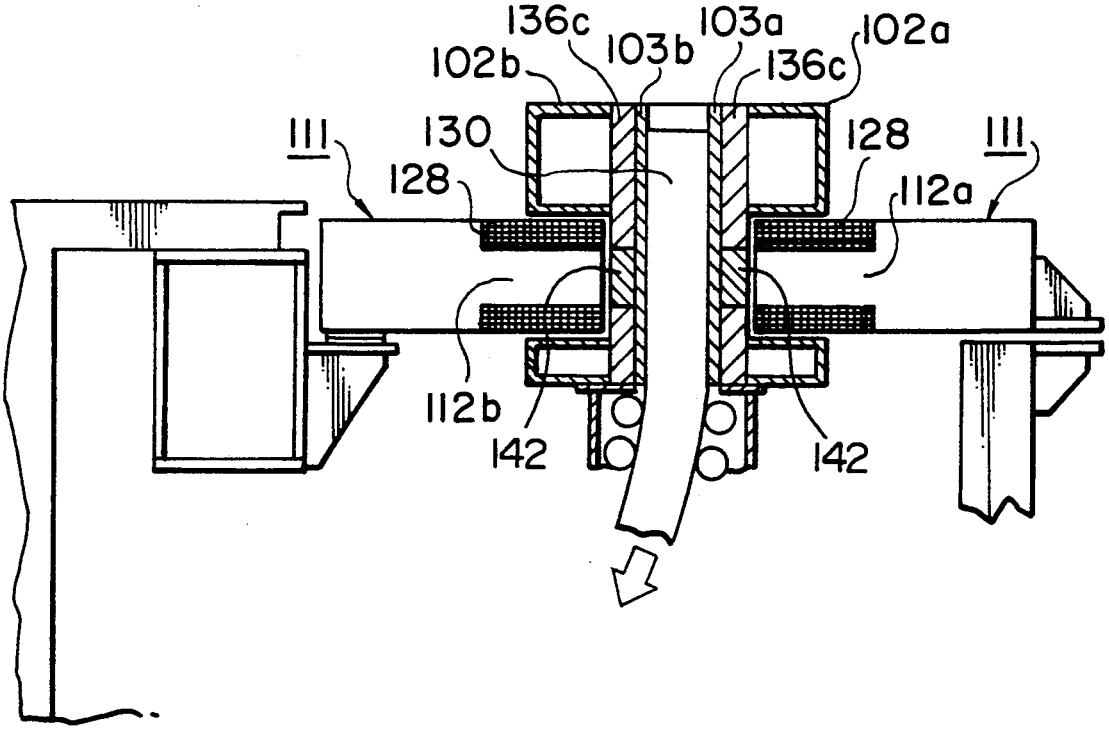
FIG. 27 is a view similar to FIG. 9, but showing the fourth embodiment.
Figure 28:
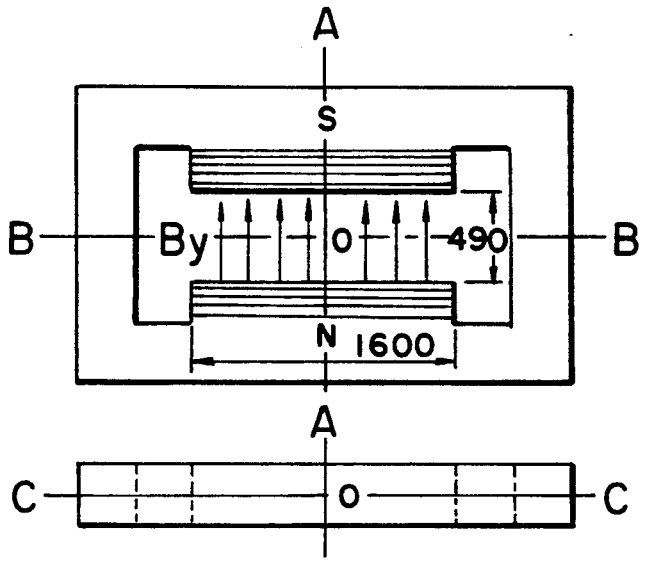
FIG. 28 is a view showing a general construction of the electromagnetic of the fourth embodiment.

As shown in FIGS. 25 to 27, that portion of the stainless steel backup plate 136C which faces the magnetic pole 112 and is disposed 100 mm outward from each end of the magnetic pole 112 and 250 mm inward therefrom toward the center of the magnetic pole at a height generally equal to the height of the magnetic pole 112 is made of a magnetic material 142.

Figure 29:
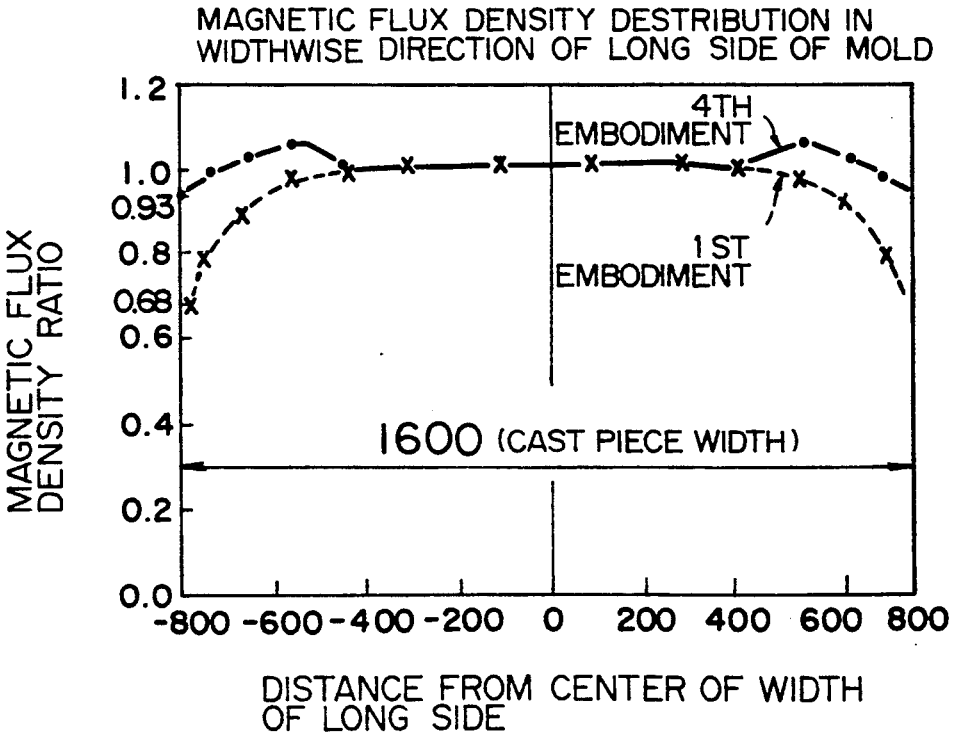
FIG. 29 is a graph showing a comparison between magnetic flux density ratios of the first and fourth embodiments.

FIG. 29 shows a comparison between the first embodiment and the fourth embodiment in which the magnetic poles having a width of 1600 mm and a height of 200 mm are used with the casting mold having a casting width of 1600 mm and a casting thickness 260 mm. As shown in FIG. 29, the magnetic flux distribution in the direction of the long side of the casting mold which was attenuated 32% at the opposite ends thereof could be reduced to an attenuation of 7%.

FIGS. 30A to 44 show a casting mold and an electromagnetic brake according to a fifth embodiment of the present invention.

Figure 31:
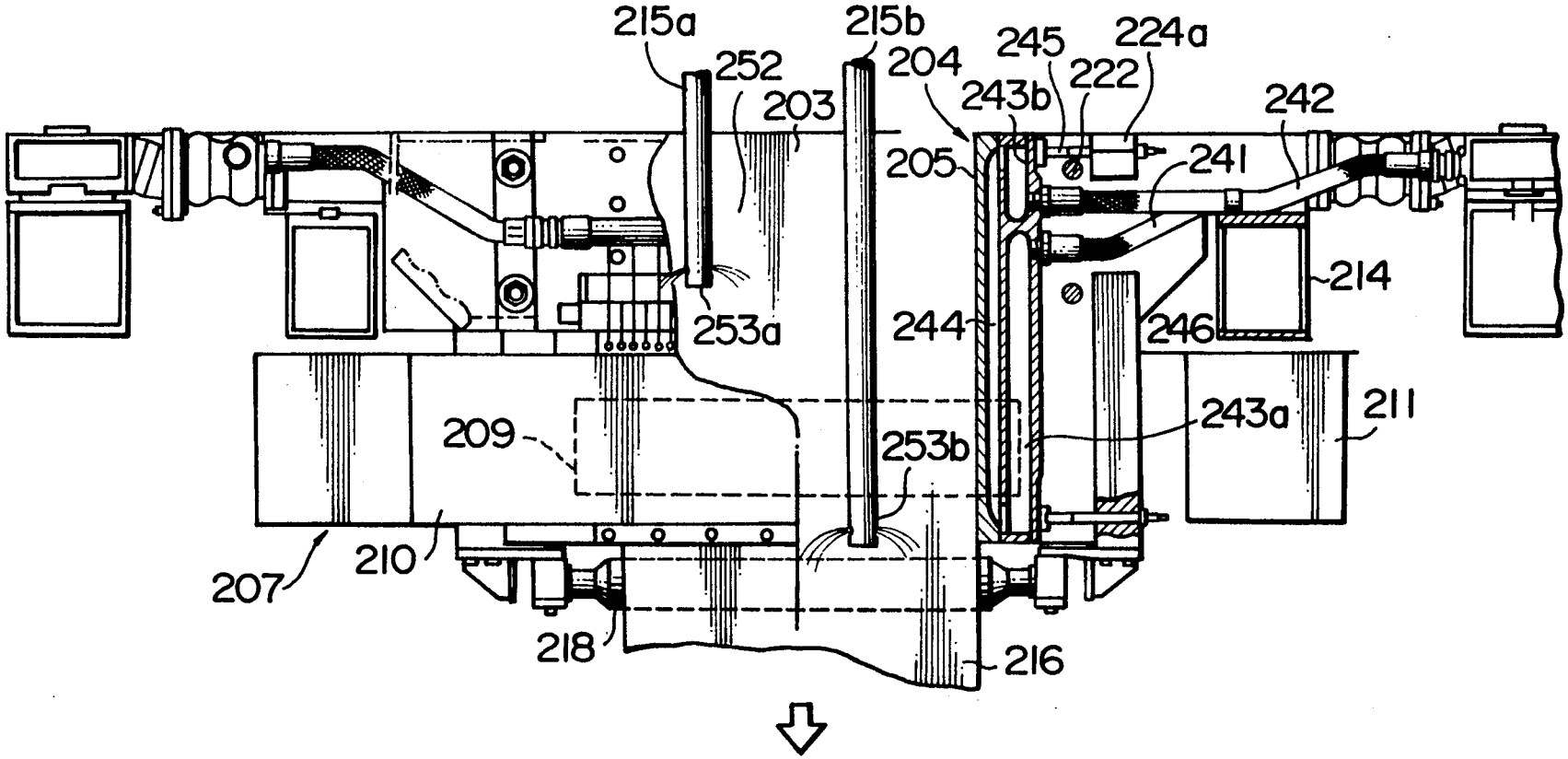
FIG. 31 is a cross-sectional view taken along the line XXXI—XXXI of FIG. 30A.

In these Figures, two immersion nozzles 215*a*, 215*b* are inserted into a casting mold 201, and metal for a surface layer and metal for an inner layer are injected from the immersion nozzles 215*a* and 215*b*, respectively. As shown in FIG. 31, an electromagnet 207 is disposed at the lower portion of the casting mold 201, and is disposed between injection ports 253*a*, 253*b* of the immersion nozzles 215*a*, 215*b*. The electromagnet surrounds the outer side of the casting mold 201 constituted by long-side copper plates 203 and shortside copper plates 205. 252 denotes molten steel, and 216 denotes a double-layer cast piece.

The casting mold 201 comprises the long-side copper plates 203 which are supported at upper portions thereof by water boxes 202*a*, 202*b* and are supported at lower portions thereof by magnetic poles 209 of the electromagnet 207, short-side support plates 224*a*, 224*b* (see FIG. 31) mounted on the water box 202*b*, short-side backup plates 204 positioned and supported by jack bolts 245 mounted on the short-side support plates, the short-side copper plates 205supported by the short-side backup plates, disk springs 206 (see FIG. 32) for firmly holding the short-side copper plates 205 between the long-side copperplates 203 during the casting, a clamp device 225 composed of tie rods 221 and nuts 222, and a mold base frame 214 supporting all of these parts.

Figure 32:
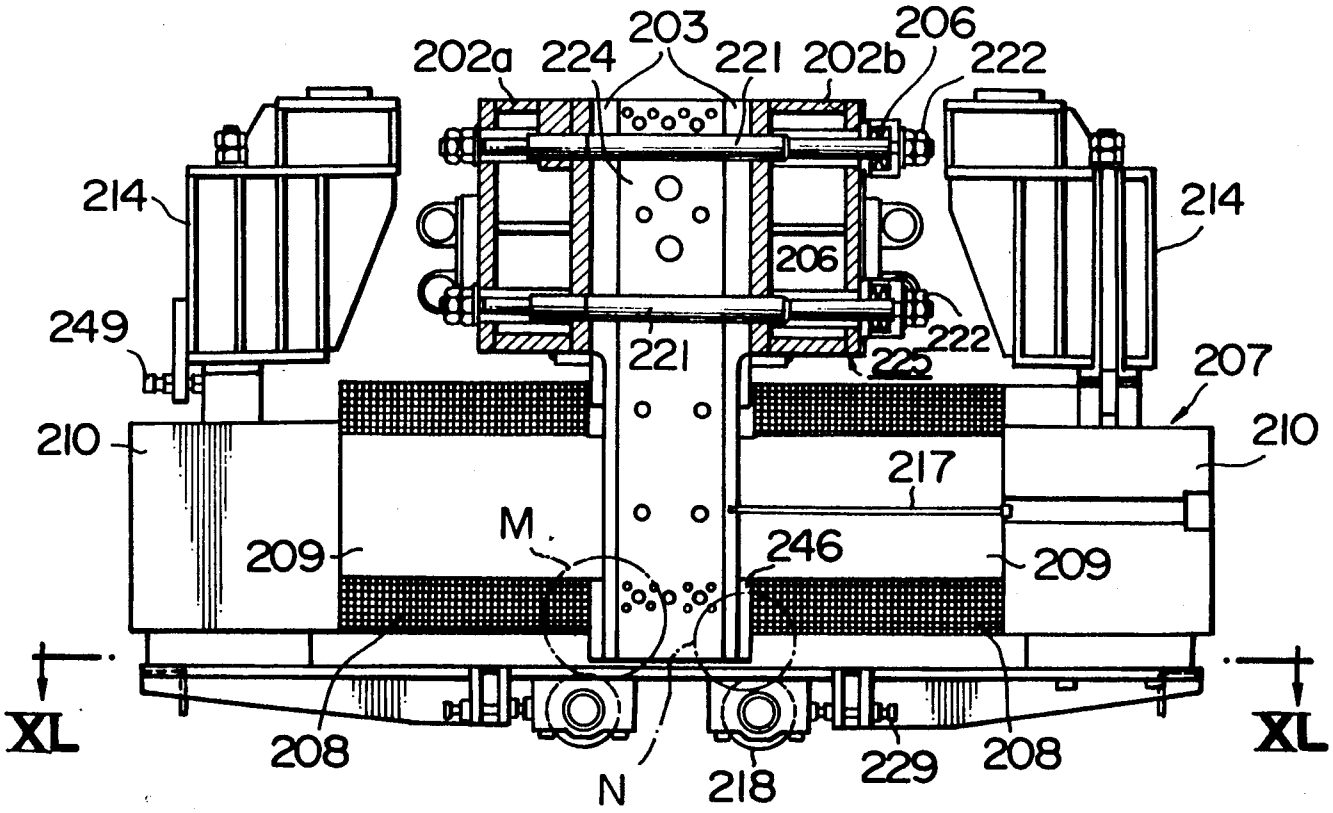
FIG. 32 is a cross-sectional view taken along the line XXXII—XXXII of FIG. 30A.
Figure 33:
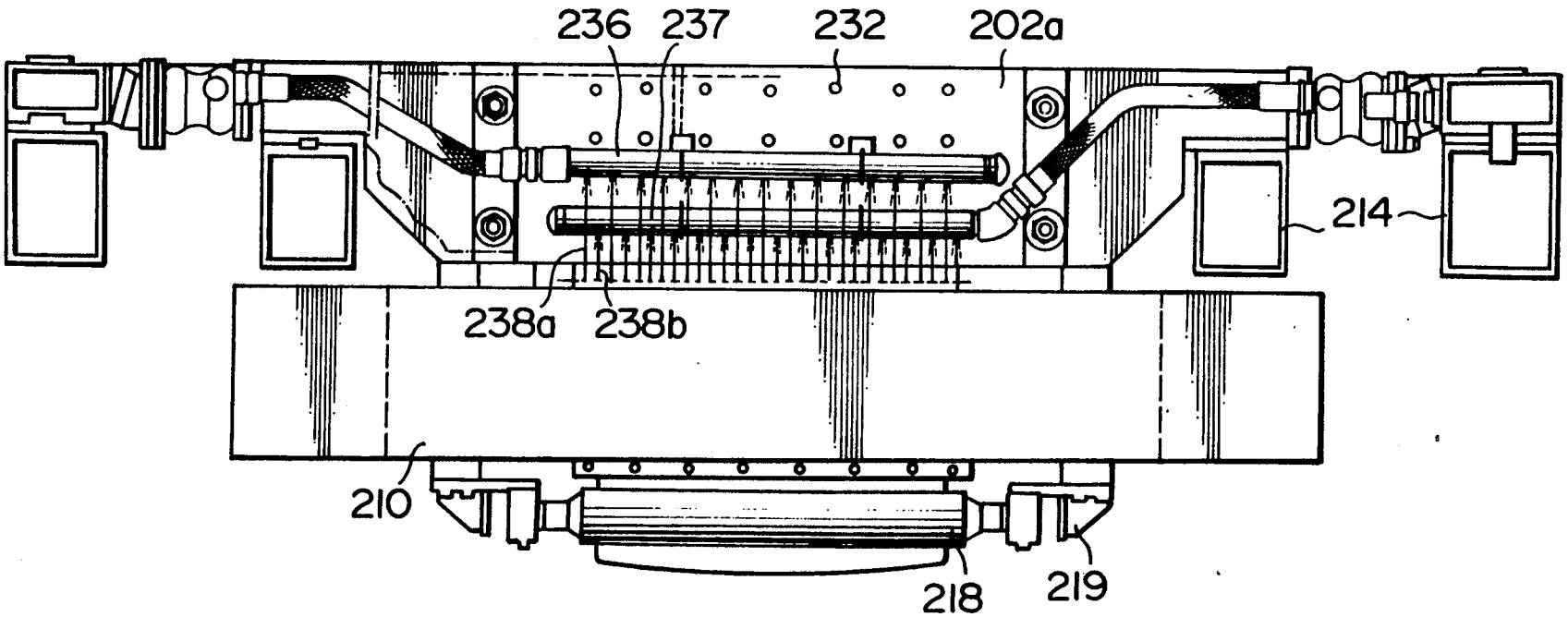
FIG. 33 is a cross-sectional view taken along the line XXXIII—XXXIII of FIG. 30A.
Figure 37:
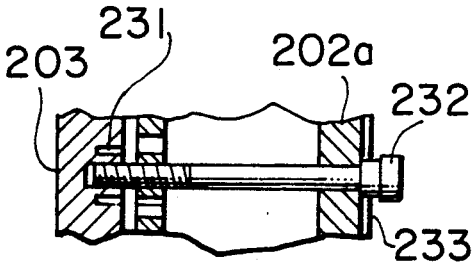
FIG. 37 is a cross-sectional view taken along the line XXXVII—XXXVII of FIG. 35.
Figure 38:
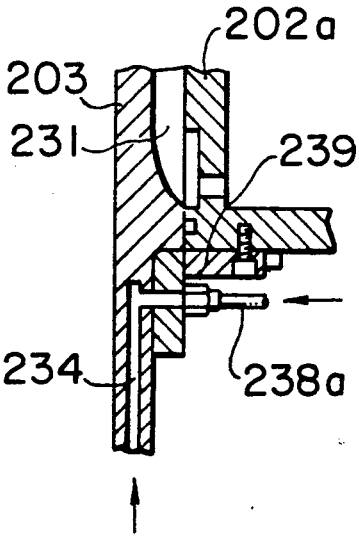
FIG. 38 is a detailed view of a portion I of FIG. 35.
Figure 43:
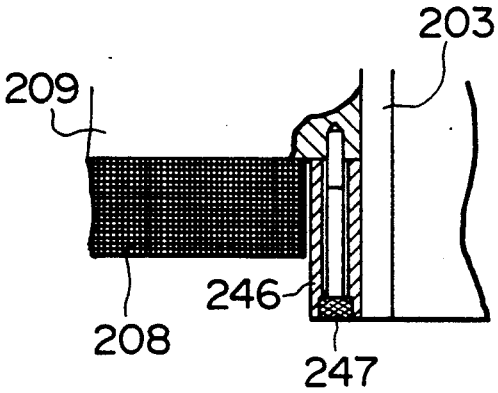
FIG. 43 is a detailed view of a portion M of FIG. 32.
Figure 44:
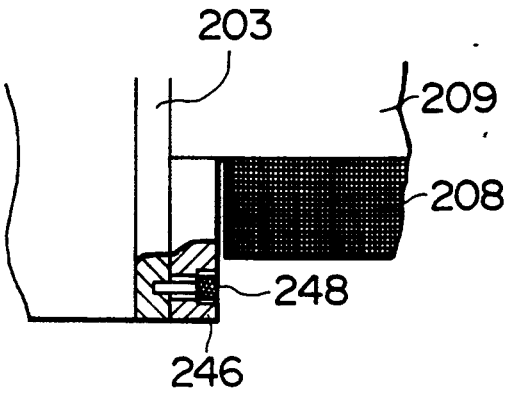
FIG. 44 is a detailed view of a portion N of FIG. 32.
Figure 45:
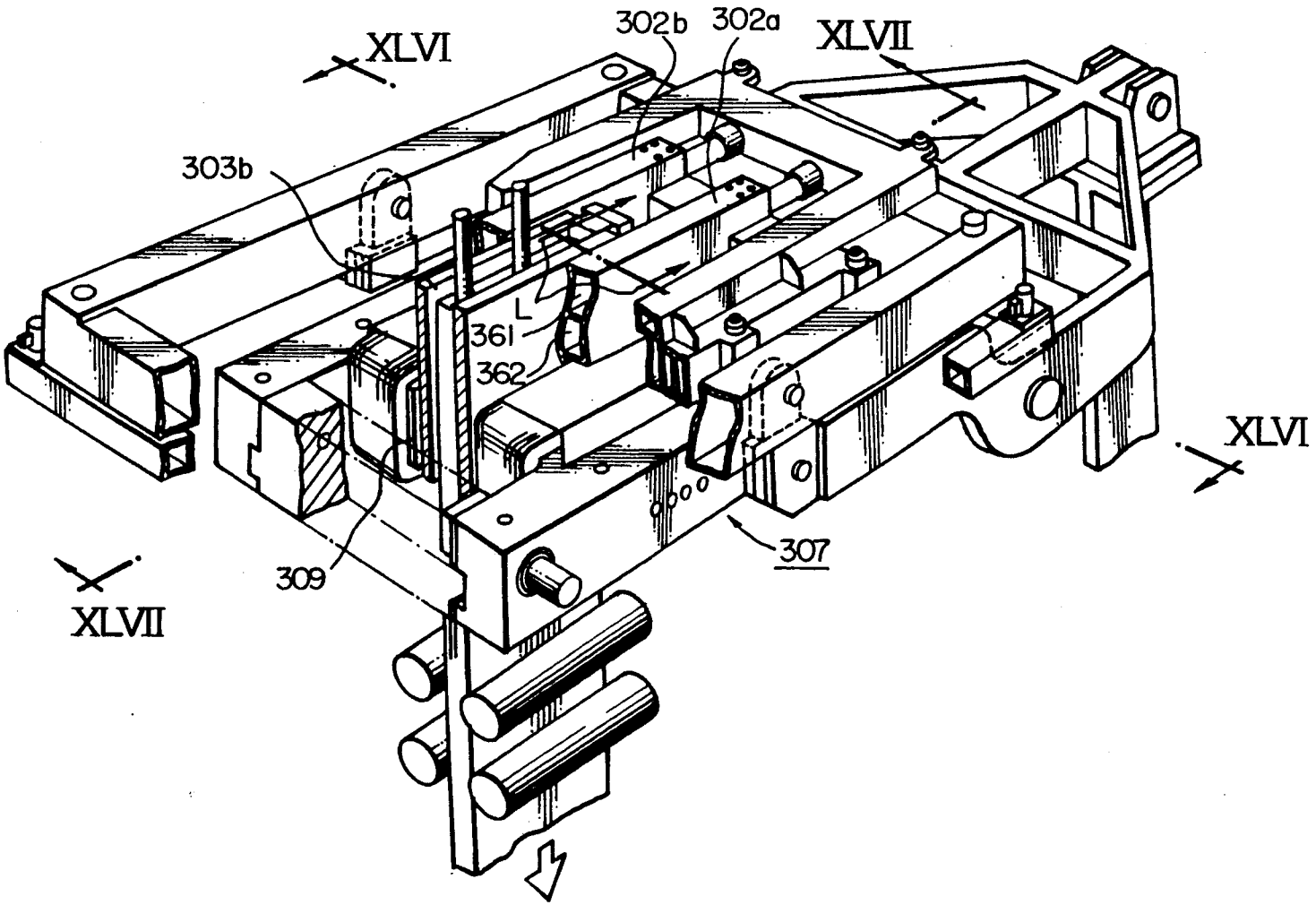
FIG. 45 is a partly-broke, perspective view, showing an overall construction of a continuous casting mold according to a sixth embodiment of the present invention.
Figure 46:
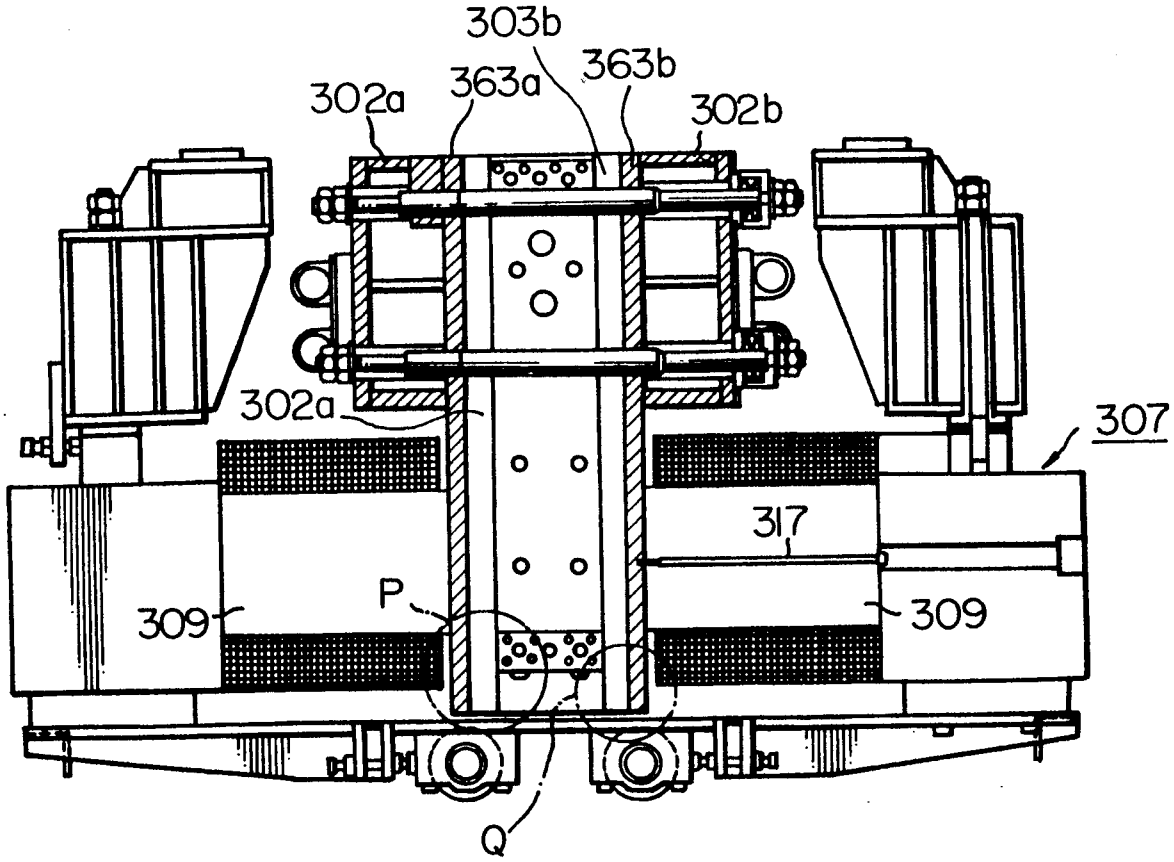
FIG. 46 is a cross-sectional view taken along the line XLVI—XLVI of FIG. 45.
Figure 47:
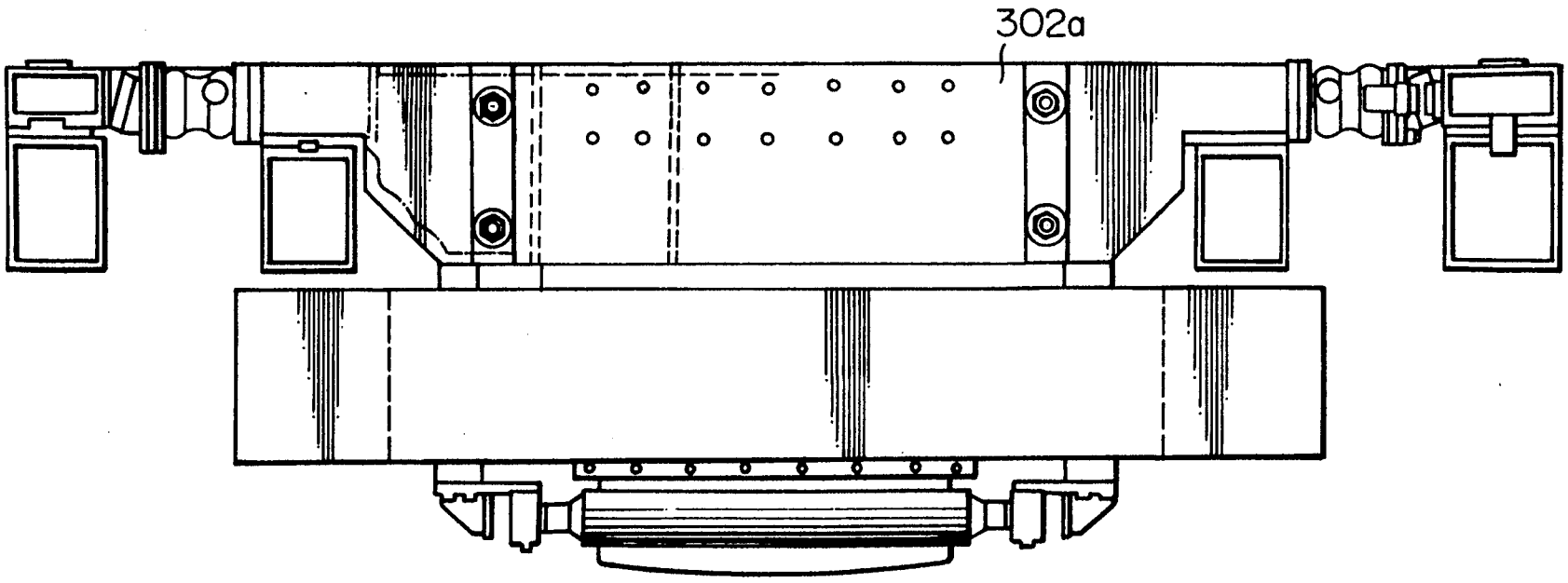
FIG. 47 is a cross-sectional view taken along the line XLVII—XLVII of FIG. 45.
Figure 48:
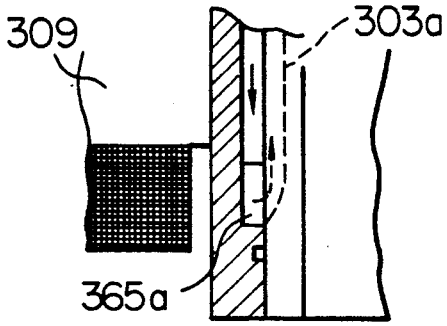
FIG. 48 is a detailed view of a portion P of FIG. 46.
Figure 49:
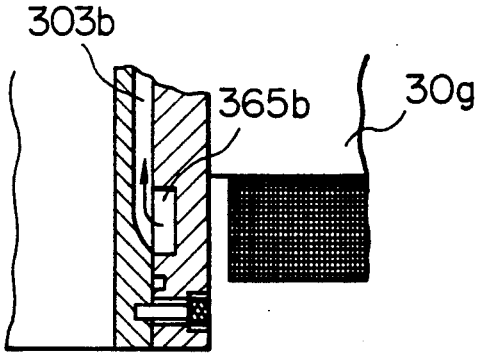
FIG. 49 is a detailed view of a portion Q of FIG. 46.
Figure 50:
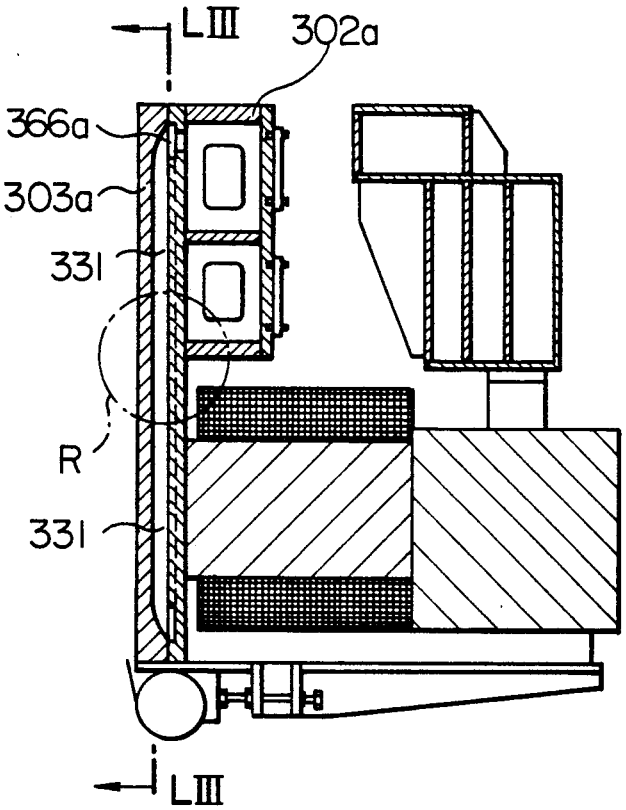
FIG. 50 is a cross-section view taken along the line L—L of FIG. 45.
Figure 51:
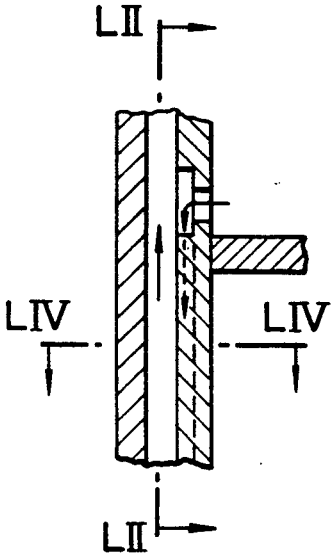
FIG 51 is a detailed view of a portion R of FIG. 50.
Figure 52:
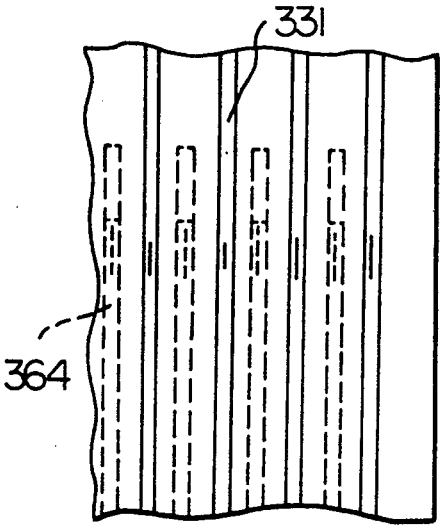
FIG. 52 is a cross-sectional view taken along the line LII—LII of FIG. 51.
Figure 54:
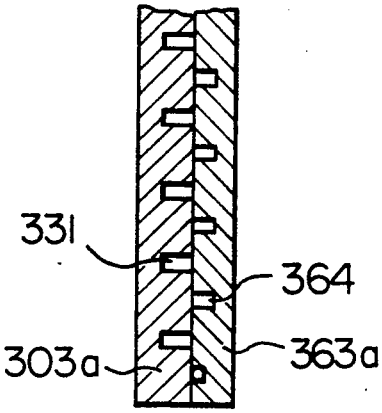
FIG. 54 is a cross-sectional view taken along the line LIV—LIV of FIG. 51.
Figure 53:
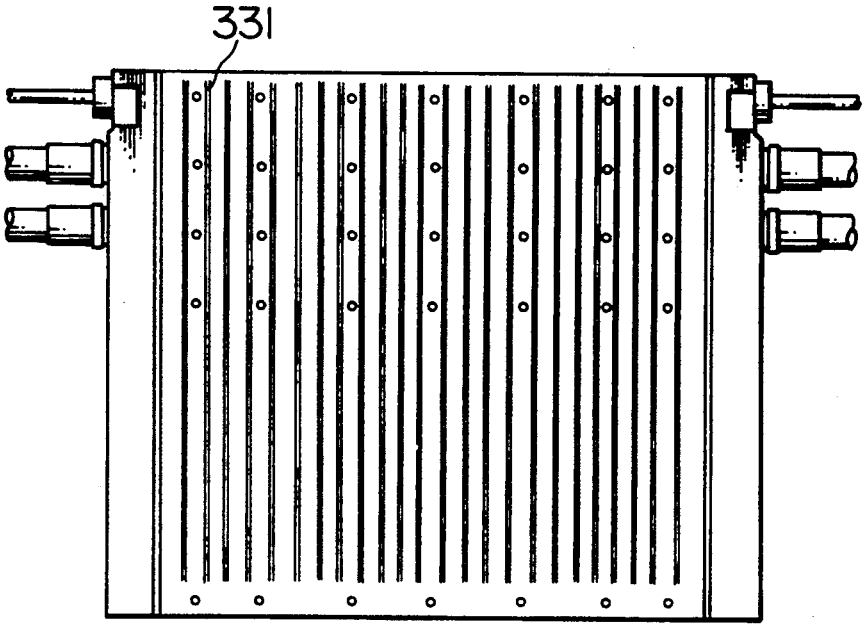
FIG. 53 is a cross-sectional view taken along the line LIII—LIII of FIG. 50.

As shown in FIGS. 33 and 37, the upper portions of the long-side copperplates 203 are fixedly supported by the water boxes 202*a* and 202*b* and a number of copper plate-mounting bolts 232 extending through these water boxes to the long-side copper plates 3. Further, as shown in FIG. 32, the lower portions of these copper plates are fixedly supported on the magnetic poles 209 by a number of bolts 217 (see FIG. 32) extending through the magnetic poles 209 of the electromagnet 207 to the copper plates 203. Further, the lower end portions which can not be supported by the magnetic poles 209 are supported by holder plates 246 mounted on the magnetic poles 209. As shown in FIGS. 43 and 44, in order to prevent the magnetic flux density of the electromagnet 207 from being lowered, a non-magnetic material (generally, austenite-type stainless steel) is used as the holder plate 246, and the holder plate is fixedly secured to the front projected portion of the magnetic pole 209 by bolts 247, and supports the lower end of the long-side copper plate 203 by a number of bolts 248 in a similar manner.

Figure 35:
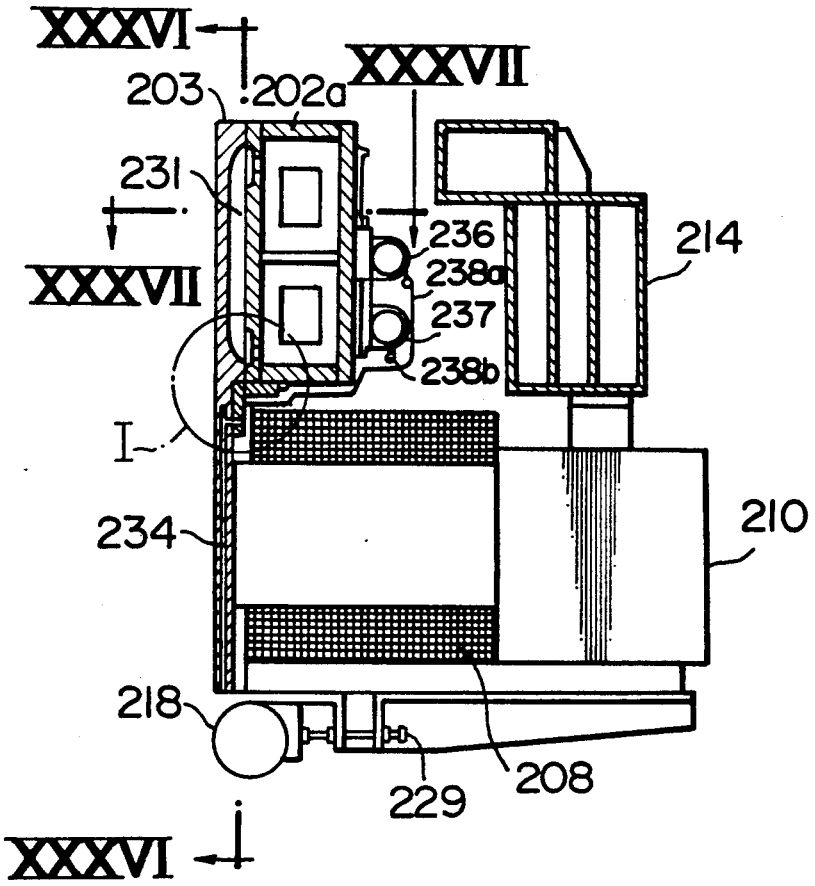
FIG. 35 is a cross-sectional view taken along the line XXXV—XXXV of FIG. 30A.
Figure 36:
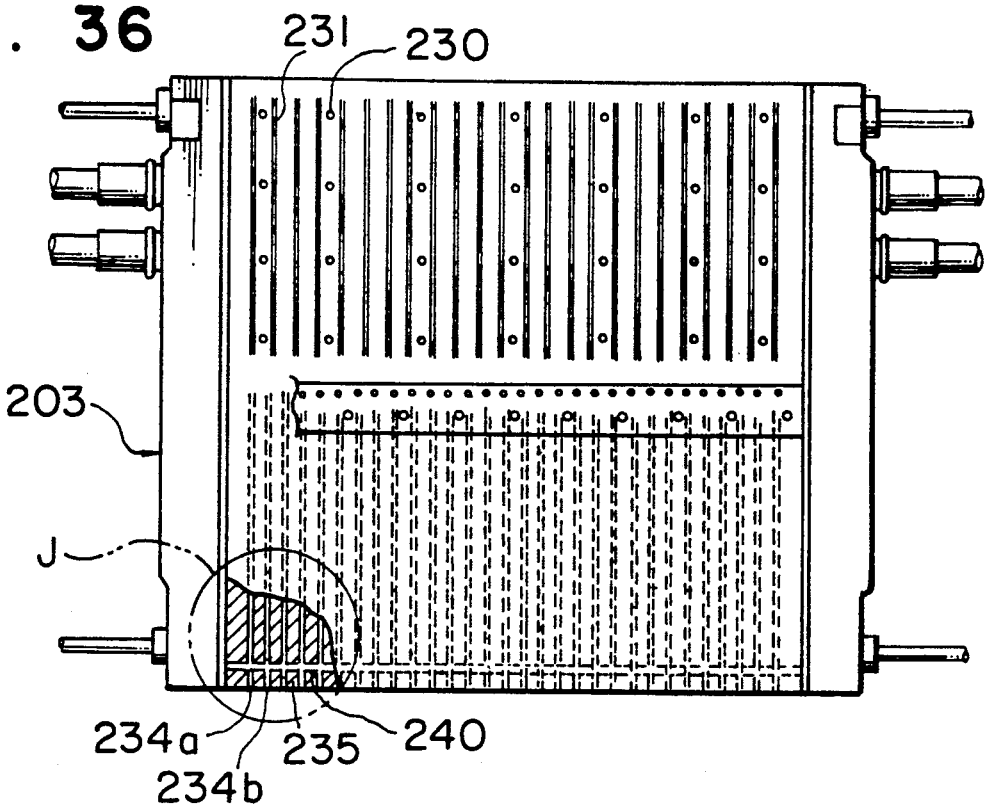
FIG. 36 is a cross-sectional view taken along the line XXXVI—XXXVI of FIG. 35.
Figure 39:
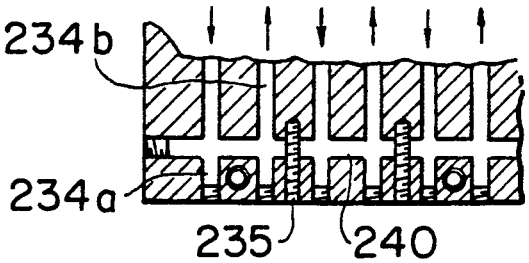
FIG. 39 is a detailed view of a portion J of FIG. 36.
Figure 40:
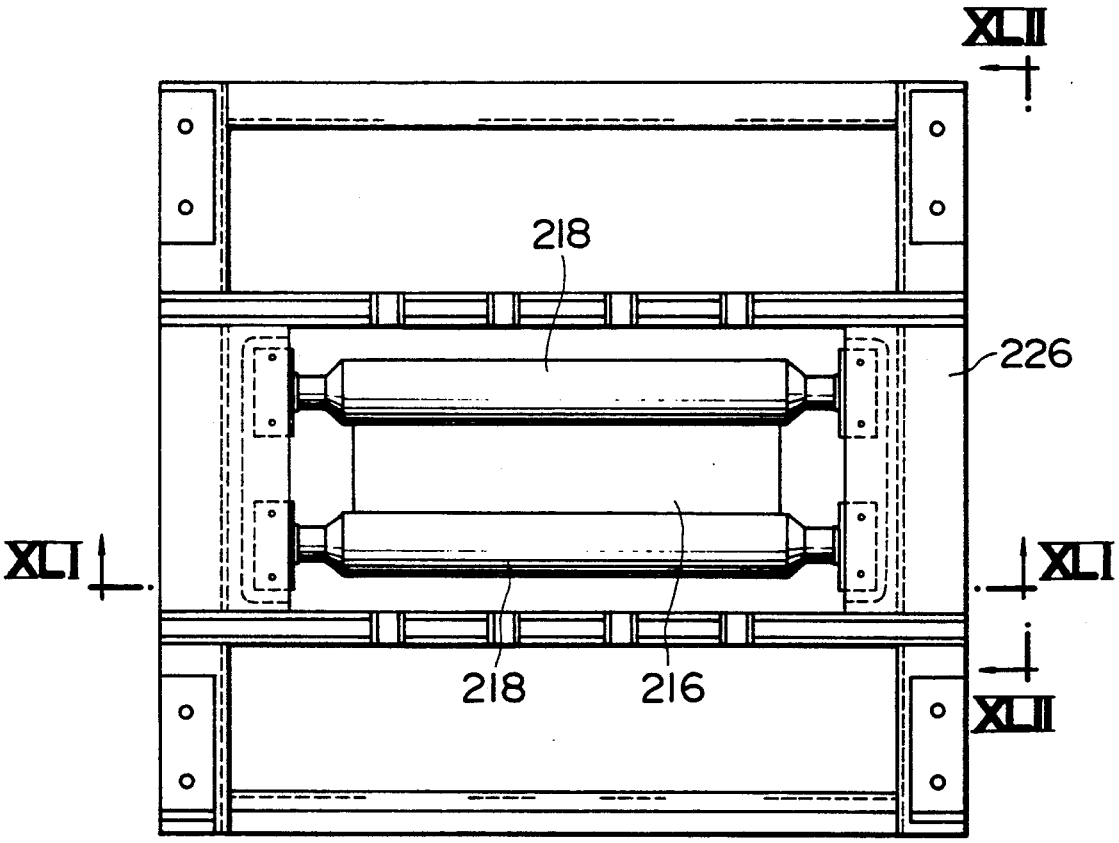
FIG. 40 is a cross-sectional view taken along the line XL—XL of FIG. 32.

Referring to FIGS. 35 and 36, for cooling the long-side copper plate 203, a number of water cooling groove 231 is provided in the upper portion of this copper plate, and cooling water for passing through these grooves is fed from and discharged to the water box 202*a*, 202*b*. The thickness of the upper portion of the long-side copper plate 203 is about half of the thickness of the upper portion thereof in order to minimize the distance between the opposed magnetic poles 209 so as to maximize the intensity of the magnetic field. For this reason, the cooling of the lower portion is effected by a number of water-cooling deep holes 234 provided therein. The cooling water is fed to the upper portion of the deep hole 234*a* from a water feed pipe 236 via a pipe 238*a* and a seal piece 239 (see FIG. 38), and passes through an adjacent deep hole 234*b* via a lower collection hole 240, as shown in FIG. 39, and is discharged to a discharge pipe 237 via a seal piece 239 and a pipe 238*b* as in the water feeding. Two adjacent ones 234*a*, 234*b* of the deep holes constitute one cooling water path, and the lower collection hole 240 is divided by plugs 235 (see FIGS. 36 and 39) for each two adjacent deep holes.

As shown in FIG. 31, cooling water for the short-side copper plate 205 is fed from a water feed hose 242 to a water hole 243*a* in the back plate 204, and passes through a cooling groove 243*b* of the short-side copper plate 205 to cool the short-side copper plate 205, and then is discharged from a discharge hose 242 via a water hole 243*b*.

Figure 30A:
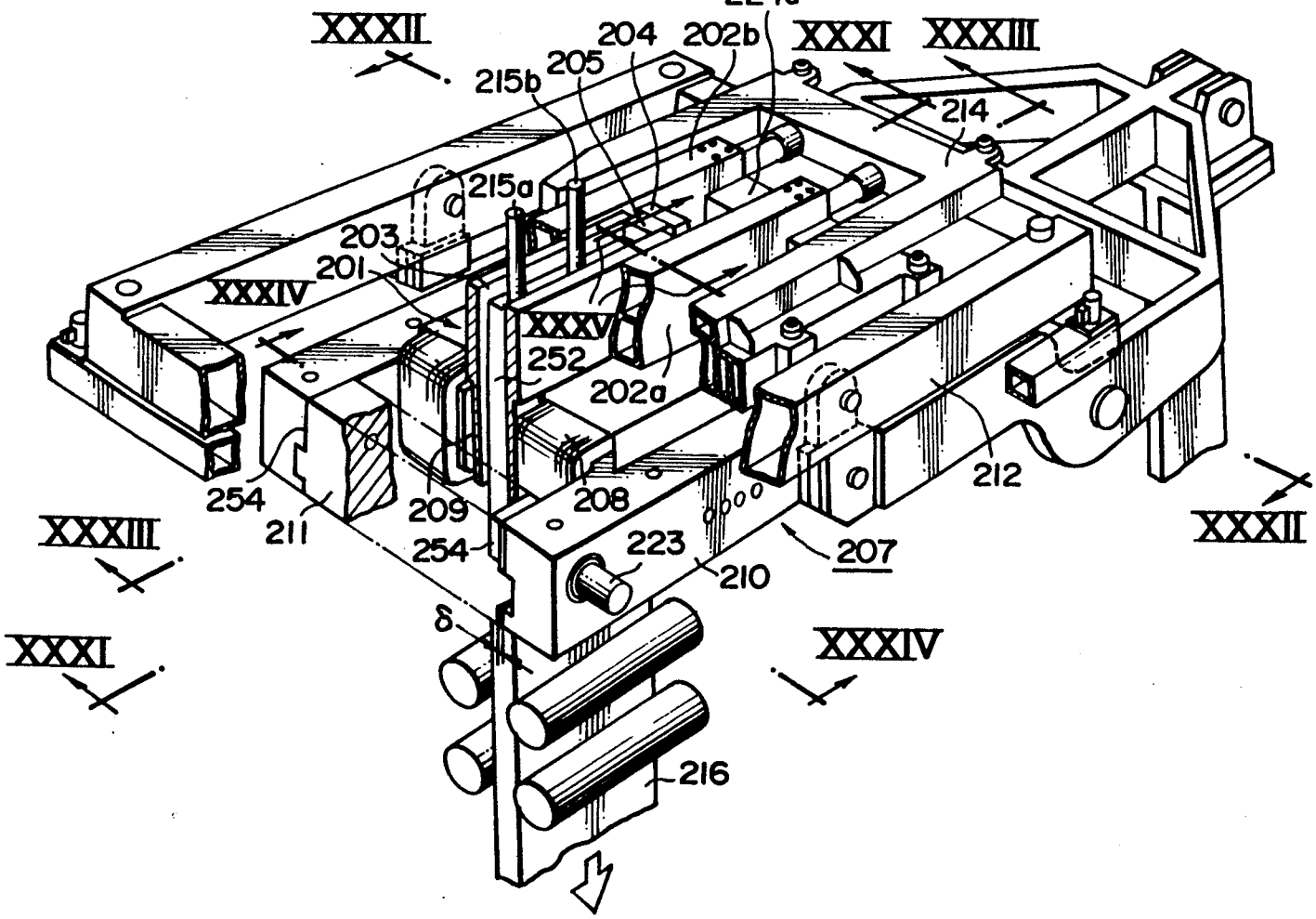
FIG. 30A is a partly-broken, perspective view showing an overall construction of a continuous casting mold according to a fifth embodiment of the present invention.
Figure 30B:
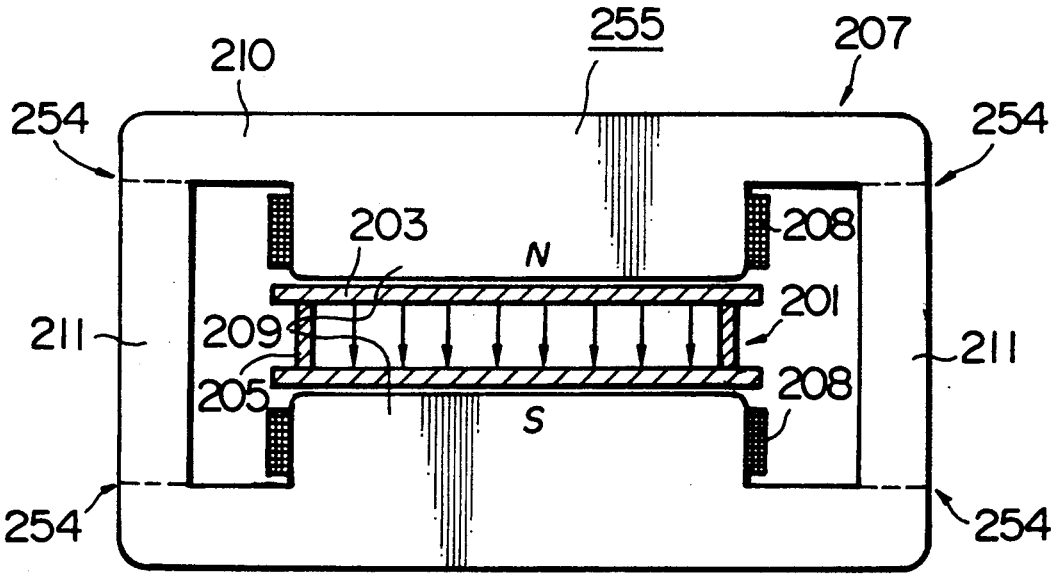
FIG. 30B is a schematic view showing the relation between the casting mold and the electromagnet in the present invention.
Figure 34:
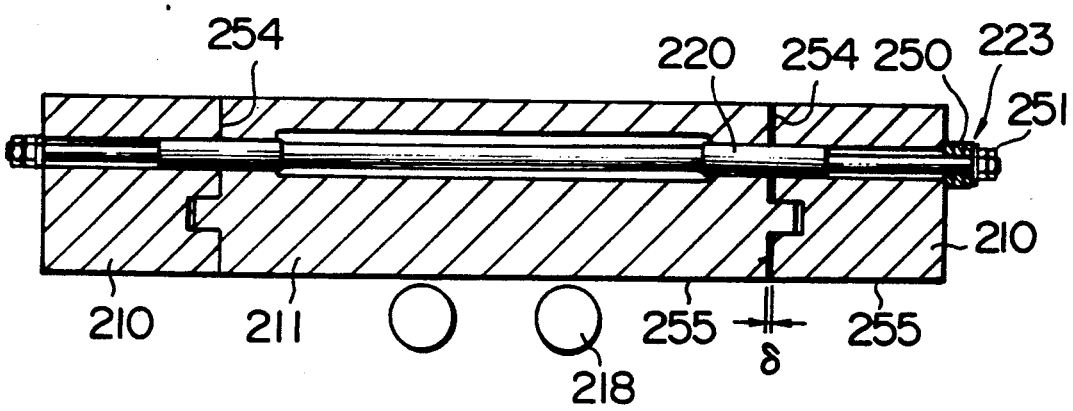
FIG. 34 is a cross-sectional view taken along the line XXXIV—XXXIV of FIG. 30A.

As shown in FIG. 30B, the electromagnet 207 comprises opposed windings 208, the opposed magnetic poles 209, opposed yokes 210 (which are provided along the long side), and short-side yokes 211 for forming a magnetic path between the magnetic poles 209. The electromagnet can be divided into four portions, that is, those portions provided at the long side and constituted by the respective windings 208, the respective magnetic poles 209 and the respective yoke 210, and the short-side yokes 211. As shown in FIG. 34, these portions can be assembled into an integral construction by a fastening device 223 comprising tie rods 220 extending through the yokes 210 and 211, disk springs 250 and nuts 251. In the drawings, 254 denotes a dividing portions for the yokes, and 255 denotes an iron core.

As shown in FIG. 32, with respect to the clamp device 225 for firmly holding the short-side copper plates 205 between the long-side copper plates 203 during the casting, the upper portion is clamped using the tie rods 221 connected between the water boxes 202*a*, 202*b* and the disk springs 206, as described above. With respect to the lower portion, when assembling the electromagnet 207 by the fastening device 232 shown in FIG. 34, a gap (about 0.5 mm) is provided at the dividing portions 254 between the yokes 210 and 211, and the short-side copper plates 205 are firmly held between the long-side copper plates 203 through the magnetic poles 209 acting against the spring forces of the disk springs 250 of the fastening device 223.

As shown in FIG. 32, the electromagnet 207 is supported by the base frame 214, and can be adjusted by jack bolts 249, mounted on the base frame 214, so as to be positioned relative to the casting mold 201.

Figure 41:
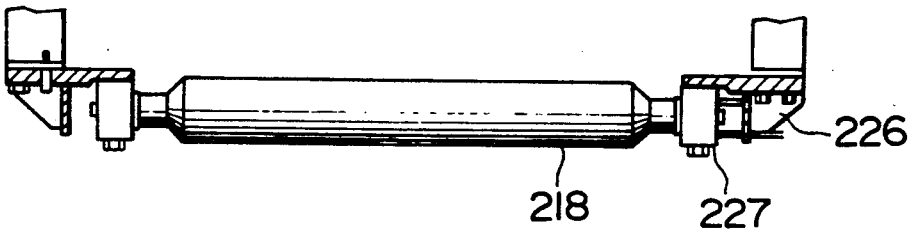
FIG. 41 is a cross-sectional view taken along the line XLI—XLI of FIG. 40.
Figure 42:
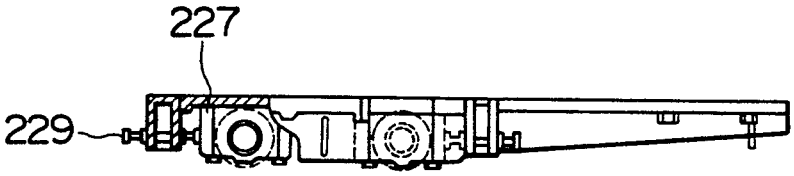
FIG. 42 is a partly cross-sectional view taken along the line XLII—XLII of FIG. 40.

As shown in FIGS. 41 and 42, foot rolls 218 provided beneath the casting mold are fixedly secured, together with chocks 227, to a foot roll-mounting frame 226, mounted on the lower surface of the yokes 210, by bolts 228, and can be adjusted, if necessary, by jack bolts 229 mounted on the mounting frame 226.

The fifth embodiment of the present invention achieves the following effects:

(1) The upper portions and lower portions of the long-side copper plates of the casting mold are directly supported by the water boxes and the magnetic poles of the electromagnet, respectively, and therefore a sufficient magnetic flux density is obtained. Further, since the electromagnet having a width generally equal to the width of the long side is provided at the lower portion of the casting molding, and is disposed between the injection ports of the two immersion nozzles, the mixing of the two layers can be limited to a minimum level, thereby enabling the production of the double-layer cast piece having a clear boundary between the surface layer and the inner layer.

(2) Such copper plate thickness and such cooling construction as heretofore sufficiently proven to be effective are applied to the upper portion of the casting mold requiring a high cooling ability and a sufficient strength against a high-temperature deformation. With respect to the lower portion allowed to be inferior in cooling ability and high-temperature strength to the upper portion, the copper plate thickness thereof is about half of that of the upper portion, thereby maximizing the magnetic flux density, and also the cooling construction is provided by the deep holes. As a result, the magnetic flux density of a level necessary for practical use is compatible with the casting ability.

(3) The electromagnet is divided into the yoke portions, respectively including the two magnetic poles and windings, and the two yoke portions for forming the magnetic paths, and can be assembled by the fastening device comprising the tie rods and the disk springs. Therefore, the assembly and disassembly of the electromagnet can be done easily, and the time and cost for maintenance of the casting mold can be saved.

Further, when assembling the electromagnet by the fastening device, the gap is provided between the yokes, and the short-side copper plates can be held between the long-side copper plates by the force of the disk springs in the fastening device. Therefore, the cross-section of the casting mold can be maintained even during the casting, thereby ensuring the precision of the cross-sectional shape and dimensions of the casting mold and the quality of the cast piece.

FIGS. 45 to 54 show a sixth embodiment of the present invention, and this sixth embodiment differs from the fifth embodiment on the following points. Namely, each of water boxes 302*a*, 302*b* has a water feed box 362 and a water discharge box 361, and backup plates 363*a*, 363*b* respectively fix and support long-side copper plates 303*a*, 303*b* from the upper portion to the lower portion. The backup plates 363*a*, 363*b* are fixedly supported on magnetic poles 309 of an electromagnet 307 by a number of bolts 317 extending through the magnetic poles 309. The cooling of the long-side copper plates 303*a*, 303*b* is effected by feeding cooling water to a number of grooves 331 formed in the copper plates 303*a*, 303*b* from the upper portion thereof to the lower portion thereof. The water is supplied to the grooves 331 from a number of grooves 364 which are formed in those surfaces of the backup plates 363*a*, 363*b* to which the copperplates 303*a*, 303*b* are attached, respectively, the grooves 364 being provided at such positions as not to interfere with the grooves 331. More specifically, the cooling water to be fed to the copper plates flows down from the water feed boxes 362 through the grooves 364 in the backup plates 363*a*, 363*b*, and flows up through the cooling water grooves 331, formed in the copper plates 303*a*, 303*b*, via water feed headers 365*a*, 365*b* provided at the lower end portions, and is discharged to the water discharge boxes 361 via water discharge headers 366*a*, 366*b* provided at the upper end portions, thereby achieving an effective cooling of the copper plates 303*a*, 303*b*.

The sixth embodiment of the present invention achieves the following effects:

(1) The long-side copper plate of the casting mold is ground, for example, in order to remove mars on the surface thereof after the copper plate is used many times. At this time, even if the fixing of the electromagnet and the magnetic pole relative to the lower portion of the copper plate is released, a free deformation of the copper plate is limited by the backup plate, and therefore as train-removing operation before the grinding is not needed, and also the amount of grinding is kept to a minimum, thereby prolonging the lifetime of the copper plate and also reducing the running cost.

(2) The upper and lower portions of the copper plate are the same in thickness, and also the cooling construction at the upper portion is the same as that at the lower portion, and therefore the reduction of the manufacturing cost can be achieved.

We claim:

1. An electromagnetic brake device for a continuous casting mold, comprising an electromagnet including magnetic poles which are provided respectively at long sides of the casting mold of a rectangular cross-section and are disposed in opposed relation to each other; a magnetic field, produced between said magnetic poles, acting on a flow of molten steel moving in a perpendicular direction to said magnetic field to thereby produce induction current for producing an electromagnetic force by which the molten steel flow is restrained; a width of said magnetic pole of said electromagnet in a horizontal direction being equal to or greater than a width of the long side of said casting mold; and a height of said magnetic pole of said electromagnet in a vertical direction being greater at its end portions than at its central portion.

2. An electromagnetic brake device for a continuous casting mold according to claim 1, in which said magnetic poles are disposed at a level below a molten steel injection port of an immersion nozzle.

3. An electromagnetic brake device for a continuous casting mold according to claim 2, in which said casting mold is placed on a mold vibration table, said electromagnet being supported by an electromagnet support device separate from said mold vibration table.

4. An electromagnetic brake device for a continuous casting mold according to claim 2, in which a support member capable of supporting said casting mold is mounted on said electromagnet, said support member enabling an exchange of said casting mold and said electromagnet in such a manner that said casting mold and said electromagnet are integrally jointed together.

5. An electromagnetic brake device for a continuous casting mold according to claim 1, in which there is provided a mold support frame for supporting said electromagnet, water boxes and said casting mold.

6. An electromagnetic brake device for a continuous casting mold according to claim 1, for use in a continuous casting apparatus which comprises two immersion nozzles whose molten steel injection ports are disposed respectively at different heights, and the casing mold of a rectangular cross-section; said brake device comprising said electromagnet comprising magnetic poles which are provided respectively at long sides of the casting mold and are disposed in opposed relation to each other, said magnetic pole having a width generally equal to a width of the long side of said casting mold; coils wound on outer peripheries of said magnetic poles, respectively; and an iron core provided in surrounding relation to said casting mold; said magnetic poles being disposed between said two molten steel injection ports.

7. An electromagnetic brake device for a continuous casting mold, comprising an electromagnet including magnetic poles which are provided respectively at long sides of the casting mold of a rectangular cross-section and are disposed in opposed relation to each other, said magnetic pole having a width generally equal to a width of the long side of said casting mold; said electromagnet controlling and restraining the flowing of molten steel, fed from an immersion nozzle of a continuous casting apparatus, by an electromagnetic force; portions of backup plates which support the long sides of said casting mold being made of a magnetic material; and those portions made of said magnetic material being disposed near the ends of said magnetic poles, respectively.

8. An electromagnetic brake device for a continuous casting mold according to claim 7, in which that portion made of said magnetic material is extended in a horizontal direction about100 mm to about 250 mm from the end of said magnetic pole toward the central portion of the magnetic pole, and also is extended in a vertical direction at least over a height of said magnetic pole.

9. An electromagnetic brake device for a continuous casting mold according to claim 6 in which said magnetic poles are disposed at a level below a molten steel injection port of an immersion nozzle.

10. An electromagnetic brake device for a continuous casting mold according to claim 9, in which said casting mold is placed on a mold vibration table, said electromagnetic being supported by an electromagnet support device separate from said mold vibration table.

11. An electromagnetic brake device for a continuous casting mold according to claim 9, in which a support member capable of supporting said casting mold is mounted on said electromagnet, said support member enabling an exchange of said casting mold and said electromagnet in such a manner that said casting mold and said electromagnet are integrally jointed together.

12. An electromagnetic brake device for a continuous casting mold according to claim 7, in which there is provided a mold support frame for supporting said electromagnet, water boxes and said casting mold.

13. An electromagnetic brake device for a continuous casting mold according to claim 7, for use in a continuous casting apparatus which comprises two immersion nozzles whose molten steel injection ports are disposed respectively at different heights, and the casting mold of a rectangular cross-section; said brake device comprising said electromagnet comprising magnetic poles which are provided respectively at long sides of the casting mold and are disposed in opposed relation to each other, said magnetic pole having a width generally equal to a width of the long side of said casting mold; coils wound on outer peripheries of said magnetic poles, respectively; and an iron core provided in surrounding relation to said casting mold; said magnetic poles being disposed between said two molten steel injection ports.

14. An electromagnetic brake device for a continuous casting mold according to claim 8, in which said magnetic poles are disposed at a level below a molten steel injection port of an immersion nozzle.

15. An electromagnetic brake device for a continuous casting mold according to claim 13, in which said casting mold is placed on a mold vibration table, said electromagnet being supported by an electromagnet support device separate from said mold vibration table.

16. An electromagnetic brake device for a continuous casting mold according to claim 13, in which a support member capable of supporting said casting mold is mounted on said electromagnetic, said support member enabling an exchange of said casting mold and said electromagnet in such a manner that said casting mold and said electromagnet are integrally joined together.

17. An electromagnetic brake device for a continuous casting mold according to claim 8, in which there is provided a mold support frame for supporting said electromagnet, water boxes and said casting mold.

18. An electromagnetic brake device for a continuous casting mold according to claim 8, for use in a continuous casting apparatus which comprises two immersion nozzles whose molten steel injection ports are disposed respectively at different heights, and the casting mold of a rectangular cross-section; said brake device comprising said electromagnet comprising magnetic poles which are provided respectively at long sides of he casting mold and are disposed in opposed relation to each other, said magnetic pole having a width generally equal to a width of the long side of said casting mold; coils wound on outer peripheries of said magnetic poles, respectively; and an iron core provided in surrounding relation to said casting mold; said magnetic poles being disposed between said two molten steel injection ports.

* * * * *